US011763764B2

(12) United States Patent
Shi et al.

(10) Patent No.: US 11,763,764 B2
(45) Date of Patent: Sep. 19, 2023

(54) CONTROL METHOD FOR ELECTRONIC INK SCREEN, DISPLAY CONTROL APPARATUS, AND ELECTRONIC INK DISPLAY APPARATUS

(71) Applicants: Chongqing BOE Smart Electronics System Co., Ltd., Chongqing (CN); BOE TECHNOLOGY GROUP CO., LTD., Beijing (CN)

(72) Inventors: Lianghui Shi, Beijing (CN); Yuanzhuo Liu, Beijing (CN)

(73) Assignees: Chongqing BOE Smart Electronics System Co., Ltd, Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/921,151

(22) PCT Filed: Apr. 12, 2021

(86) PCT No.: PCT/CN2021/086516
§ 371 (c)(1),
(2) Date: Oct. 25, 2022

(87) PCT Pub. No.: WO2021/233003
PCT Pub. Date: Nov. 25, 2021

(65) Prior Publication Data

US 2023/0186866 A1 Jun. 15, 2023

(30) Foreign Application Priority Data

May 20, 2020 (CN) ..... 202010430201.0

(51) Int. Cl.
*G09G 3/34* (2006.01)
*G09G 3/20* (2006.01)

(52) U.S. Cl.
CPC ..... *G09G 3/344* (2013.01); *G09G 3/2003* (2013.01); *G09G 2310/062* (2013.01)

(58) Field of Classification Search
CPC ..... G09G 3/2003; G09G 3/344; G09G 2310/068; G09G 2310/062; G02F 1/167; G02F 1/1685; G02F 2001/1678
See application file for complete search history.

(56) References Cited

U.S. PATENT DOCUMENTS

2002/0015016 A1 2/2002 Kudo et al.
2003/0080933 A1 5/2003 Kondoh
(Continued)

FOREIGN PATENT DOCUMENTS

CN 1758316 A 4/2006
CN 101782707 A 7/2010
(Continued)

OTHER PUBLICATIONS

First Office Action for Chinese Patent Application No. 202010430201.0 issued by the Chinese Patent Office dated Dec. 21, 2020.

*Primary Examiner* — Priyank J Shah
(74) *Attorney, Agent, or Firm* — IP & T GROUP LLP

(57) ABSTRACT

A control method for an electronic ink screen includes: when colors of an image to be displayed include only a black color and a white color, outputting a first black driving signal, and outputting a first white driving signal; and when the colors of the image to be displayed include the black color, the white color and a chromatic color, outputting a second black driving signal, outputting a second white driving signal, and outputting a chromatic driving signal. A duration of the first black driving signal is equal to a duration of the first white driving signal. A duration of the second black driving signal, a duration of the second white driving signal and the duration of the chromatic driving signal are equal. The
(Continued)

duration of the second white driving signal is greater than the duration of the first white drive signal.

20 Claims, 6 Drawing Sheets

(56) References Cited

U.S. PATENT DOCUMENTS

| | | | | |
|---|---|---|---|---|
| 2013/0009931 | A1 | 1/2013 | Yeo et al. | |
| 2018/0240412 | A1* | 8/2018 | Chiu | G09G 3/344 |

FOREIGN PATENT DOCUMENTS

| | | | |
|---|---|---|---|
| CN | 101847373 | A | 9/2010 |
| CN | 102867485 | A | 1/2013 |
| CN | 108461066 | A | 8/2018 |
| CN | 108461067 | A | 8/2018 |
| CN | 110366747 | A | 10/2019 |
| CN | 111508442 | A | 8/2020 |
| JP | 2003-202540 | A | 7/2003 |
| WO | 2018/200252 | A1 | 11/2018 |

* cited by examiner

CONTROL METHOD FOR ELECTRONIC INK SCREEN, DISPLAY CONTROL APPARATUS, AND ELECTRONIC INK DISPLAY APPARATUS

CROSS-REFERENCE TO RELATED APPLICATIONS

This application is a national phase entry under 35 USC 371 of International Patent Application No. PCT/CN2021/086516, filed on Apr. 12, 2021, which claims priority to Chinese Patent Application No. 202010430201.0, filed on May 20, 2020, which are incorporated herein by reference in their entirety.

TECHNICAL FIELD

The present disclosure relates to the field of display technologies, and in particular, to a control method for an electronic ink screen, a display control apparatus and an electronic ink display apparatus.

BACKGROUND

Like traditional ink, electronic ink may be printed onto surfaces of many materials (e.g., plastics, polyester films, paper, cloth, etc.). In contrast, the electronic ink can change color under action of an electric field, so that an electronic ink display apparatus made of the electronic ink can display images.

Compared with other types of displays, such as liquid crystal displays (LCDs) and organic light-emitting displays (OLEDs), the electronic ink display apparatus has advantages of low power consumption, readability, easy and cheap manufacturing, etc.

SUMMARY

In an aspect, a control method for an electronic ink screen is provided. The control method for the electronic ink screen includes: when colors of an image to be displayed include only a black color and a white color, outputting a first black driving signal to a pixel to be displayed in the black color in the electronic ink screen and outputting a first white driving signal to a pixel to be displayed in the white color in the electronic ink screen; and when the colors of the image to be displayed include the black color, the white color and a chromatic color, outputting a second black driving signal to the pixel to be displayed in the black color in the electronic ink screen, outputting a second white driving signal to the pixel to be displayed in the white color in the electronic ink screen and outputting a chromatic driving signal to a pixel to be displayed in the chromatic color in the electronic ink screen. A duration of the first black driving signal is equal to a duration of the first white driving signal. A duration of the second black driving signal, a duration of the second white driving signal and a duration of the chromatic driving signal are equal. The duration of the second white driving signal is greater than the duration of the first white driving signal.

In some embodiments, at least two first temperature ranges that are preset respectively correspond to at least two first driving signal groups, and a first driving signal group includes a first black driving signal and a first white driving signal; and in the case where the colors of the image to be displayed include only the black color and the white color, outputting the first black driving signal to the pixel to be displayed in the black color in the electronic ink screen and outputting the first white driving signal to the pixel to be displayed in the white color in the electronic ink screen, includes: according to a first temperature range which an ambient temperature is in, outputting the first black driving signal in a corresponding first driving signal group to the pixel to be displayed in the black color in the electronic ink screen, and outputting the first white driving signal in the corresponding first driving signal group to the pixel to be displayed in the white color in the electronic ink screen. And/or, at least two second temperature ranges that are preset respectively correspond to at least two second driving signal groups, and a second driving signal group includes a second black driving signal, a second white driving signal and a chromatic driving signal; and in the case where the colors of the image to be displayed include the black color, the white color and the chromatic color, outputting the second black driving signal to the pixel to be displayed in the black color in the electronic ink screen, outputting the second white driving signal to the pixel to be displayed in the white color in the electronic ink screen and outputting the chromatic driving signal to the pixel to be displayed in the chromatic color in the electronic ink screen, includes: according to a second temperature range which the ambient temperature is in, outputting the second black driving signal in a corresponding second driving signal group to the pixel to be displayed in the black color in the electronic ink screen, outputting the second white driving signal in the corresponding second driving signal group to the pixel to be displayed in the white color in the electronic ink screen and outputting the chromatic driving signal in the corresponding second driving signal group to the pixel to be displayed in the chromatic color in the electronic ink screen.

In some embodiments, the at least two first temperature ranges that are preset respectively correspond to at least two first waveform file groups that are stored, and a first waveform file group includes a waveform file of the first black driving signal and a waveform file of the first white driving signal; and in the case where the colors of the image to be displayed include only the black color and the white color, outputting the first black driving signal to the pixel to be displayed in the black color in the electronic ink screen and outputting the first white driving signal to the pixel to be displayed in the white color in the electronic ink screen, includes: according to a waveform file of the first black driving signal in the first waveform file group corresponding to the first temperature range which the ambient temperature is in, outputting the first black driving signal to the pixel to be displayed in the black color in the electronic ink screen; and according to the waveform file of the first white driving signal in the first waveform file group corresponding to the first temperature range which the ambient temperature is in, outputting the first white driving signal to the pixel to be displayed in the white color in the electronic ink screen. And/or, the at least two second temperature ranges that are preset respectively correspond to at least two second waveform file groups, and a second waveform file group includes a waveform file of the second black driving signal, a waveform file of the second white driving signal and a waveform file of the chromatic driving signal; and in the case where the colors of the image to be displayed include the black color, the white color and the chromatic color, outputting the second black driving signal to the pixel to be displayed in the black color in the electronic ink screen, outputting the second white driving signal to the pixel to be displayed in the white color in the electronic ink screen and outputting the chromatic driving signal to the pixel to be displayed in the chromatic color in the electronic ink screen, includes: according to the waveform file of the second black driving signal in the second waveform file group corresponding to the second temperature range which the ambient temperature is in, outputting the second black driving signal to the pixel to be displayed in the black color in the electronic ink screen; according to the waveform file of the second white driving signal in the second waveform file group corresponding to the second temperature range which the ambient temperature is in, outputting the second white driving signal to the pixel to be displayed in the white color in the electronic ink screen; and according to the waveform file of the chromatic driving signal in the second waveform file group corresponding to the second temperature range which the ambient temperature is in, outputting the chromatic driving signal to the pixel to be displayed in the chromatic color in the electronic ink screen.

In some embodiments, the first black driving signal and the first white driving signal each include sub-signals of M phases; the second black driving signal, the second white driving signal and the chromatic driving signal each include sub-signals of N phases; N is greater than M. The second black driving signal includes sub-signals of M phases that are the same as the sub-signals of M phases included in the first black driving signal, and the second white driving signal includes sub-signals of M phases that are the same as the sub-signals of M phases included in the first white driving signal.

In some embodiments, outputting the first black driving signal to the pixel to be displayed in the black color in the electronic ink screen and outputting the first white driving signal to the pixel to be displayed in the white color in the electronic ink screen, includes: scanning rows of pixels in the electronic ink screen sequentially in an i-th display driving phase of displaying the image to be displayed; outputting a sub-signal of an i-th phase in the first black driving signal to the pixel to be displayed in the black color in each row of pixels that is scanned, and outputting a sub-signal of an i-th phase in the first white driving signal to the pixel to be displayed in the white color in each row of pixels that is scanned; wherein i is greater than or equal to 1 and less than or equal to M ($1 \leq i \leq M$). And/or, outputting the second black driving signal to the pixel to be displayed in the black color in the electronic ink screen, outputting the second white driving signal to the pixel to be displayed in the white color in the electronic ink screen and outputting the chromatic driving signal to the pixel to be displayed in the chromatic color in the electronic ink screen, includes: scanning the rows of pixels in the electronic ink screen sequentially in a j-th display driving phase of displaying the image to be displayed; outputting a sub-signal of a j-th phase in the second black driving signal to the pixel to be displayed in the black color in each row of pixels that is scanned, outputting a sub-signal of a j-th phase in the second white driving signal to the pixel to be displayed in the white color in each row of pixels that is scanned, and outputting a sub-signal of a j-th phase in the chromatic driving signal to the pixel to be displayed in the chromatic color in each row of pixels that is scanned; wherein j is greater than or equal to 1 and less than or equal to N ($1 \leq j \leq N$).

In some embodiments, N is equal to 7 (N=7), and M is equal to 5 (M=5).

In some embodiments, the sub-signals from a first phase to a seventh phase included in the second black driving signal are sequentially: a black pull-down signal, a first rectangular wave, a second rectangular wave, a third rectangular wave, an electric field cancellation signal, a black push-up signal and an another electric field cancellation signal. The black pull-down signal is configured to drive black particles in a pixel to move to a side away from a display surface of the electronic ink screen. A frequency of the first rectangular wave is a first frequency. A frequency of the second rectangular wave is a second frequency. A frequency of the third rectangular wave is a third frequency. The black push-up signal is configured to drive the black particles in the pixel to move to a side proximate to the display surface of the electronic ink screen. The sub-signals from a first phase to a fifth phase included in the first black driving signal are sequentially: the black pull-down signal, the first rectangular wave, the second rectangular wave, the third rectangular wave and the black push-up signal that are all in the second black driving signal. The first frequency is greater than the third frequency, and the third frequency is greater than the second frequency.

In some embodiments, the sub-signals from a first phase to a seventh phase included in the second white driving signal are sequentially: a white pull-down signal, a fourth rectangular wave, a fifth rectangular wave, a sixth rectangular wave, an electric field cancellation signal, a white push-up signal and an another electric field cancellation signal. The white pull-down signal is configured to drive white particles in a pixel to move to a side away from a display surface of the electronic ink screen. A frequency of the fourth rectangular wave is a fourth frequency. A frequency of the fifth rectangular wave is a fifth frequency. A frequency of the sixth rectangular wave is a sixth frequency. The white push-up signal is configured to drive the white particles in the pixel to move to a side proximate to the display surface of the electronic ink screen. The sub-signals from a first phase to a fifth phase included in the first white driving signal are sequentially: the white pull-down signal, the fourth rectangular wave, the fifth rectangular wave, the sixth rectangular wave and the white push-up signal that are all in the second white driving signal. The fourth frequency is greater than the sixth frequency, and the sixth frequency is greater than the fifth frequency.

In some embodiments, the sub-signals from a first phase to a seventh phase included in the chromatic driving signal are sequentially: an electric field cancellation signal, a chromatic pull-down signal, a seventh rectangular wave, an eighth rectangular wave, a first chromatic push-up signal, an another electric field cancellation signal and a second chromatic push-up signal. The chromatic pull-down signal is configured to drive chromatic particles in a pixel to move to a side away from a display surface of the electronic ink screen. A frequency of the seventh rectangular wave is a seventh frequency. A frequency of the eighth rectangular wave is an eighth frequency. The first chromatic push-up signal is configured to drive the chromatic particles in the pixel to move to a side proximate to the display surface of the electronic ink screen. The second chromatic push-up signal is configured to drive the chromatic particles in the pixel to move to the side proximate to the display surface of the electronic ink screen. The eighth frequency is greater than the seventh frequency.

In some embodiments, the first frequency is equal to the fourth frequency, the second frequency is equal to the fifth frequency, and the third frequency is equal to the sixth frequency.

In some embodiments, in a case where the second black driving signal includes the second rectangular wave with the second frequency and the third rectangular wave with the third frequency, the seventh frequency is equal to the second frequency, and the eighth frequency is equal to the third frequency.

In some embodiments, the control method for the electronic ink screen further includes: obtaining the image to be displayed; determining whether the image to be displayed includes chromatic pixel data; if the image to be displayed includes the chromatic pixel data, the colors of the image to be displayed include the black color, the white color and the chromatic color; and if the image to be displayed does not include the chromatic pixel data, the colors of the image to be displayed include only the black color and the white color; or receiving a display mode control instruction configured to indicate that the colors of the image to be displayed include only the black color and the white color, or include the black color, the white color and the chromatic color.

In another aspect, a display control apparatus is provided. The display control apparatus includes a source driver and at least one processor. The at least one processor is configured to: when colors of an image to be displayed include only a black color and a white color, control the source driver to output a first black driving signal to a pixel to be displayed in the black color in an electronic ink screen, and to output a first white driving signal to a pixel to be displayed in the white color in the electronic ink screen; and when the colors of the image to be displayed include the black color, the white color and a chromatic color, control the source driver to output a second black driving signal to the pixel to be displayed in the black color in the electronic ink screen, to output a second white driving signal to the pixel to be displayed in the white color in the electronic ink screen, and to output a chromatic driving signal to a pixel to be displayed in the chromatic color in the electronic ink screen. A duration of the first black driving signal is equal to a duration of the first white driving signal. A duration of the second black driving signal, a duration of the second white driving signal and a duration of the chromatic driving signal are equal. The duration of the second white driving signal is greater than the duration of the first white driving signal.

In some embodiments, at least two first temperature ranges that are preset respectively correspond to at least two first driving signal groups, and a first driving signal group includes a first black driving signal and a first white driving signal; the at least one processor is configured to: in the case where the colors of the image to be displayed include only the black color and the white color, according to a first temperature range which an ambient temperature is in, control the source driver to output the first black driving signal in a corresponding first driving signal group to the pixel to be displayed in the black color in the electronic ink screen, and to output the first white driving signal in the corresponding first driving signal group to the pixel to be displayed in the white color in the electronic ink screen. And/or, at least two second temperature ranges that are preset respectively correspond to at least two second driving signal groups, and a second driving signal group includes a second black driving signal, a second white driving signal and a chromatic driving signal; the at least one processor is configured to, in the case where the colors of the image to be displayed include the black color, the white color and the chromatic color, according to a second temperature range which the ambient temperature is in, control the source driver to output the second black driving signal in a corresponding second driving signal group to the pixel to be displayed in the black color in the electronic ink screen, to output the second white driving signal in the corresponding second driving signal group to the pixel to be displayed in the white color in the electronic ink screen, and to output the chromatic driving signal in the corresponding second driving signal group to the pixel to be displayed in the chromatic color in the electronic ink screen.

In some embodiments, the display control apparatus further includes at least one memory. The at least one memory is configured to store at least two first waveform file groups. A first waveform file group includes a waveform file of the first black driving signal and a waveform file of the first white driving signal. The at least two first waveform file groups respectively correspond to the at least two first temperature ranges. In the case where the colors of the image to be displayed include only the black color and the white color, the at least one processor is configured to: according to the waveform file of the first black driving signal in the first waveform file group corresponding to the first temperature range which the ambient temperature is in, control the source driver to output the first black driving signal to the pixel to be displayed in the black color in the electronic ink screen; and according to the waveform file of the first white driving signal in the first waveform file group corresponding to the first temperature range which the ambient temperature is in, control the source driver to output the first white driving signal to the pixel to be displayed in the white color in the electronic ink screen. And/or, the at least one memory is configured to store at least two second waveform file groups. A second waveform file group includes a waveform file of a second black driving signal, a waveform file of a second white driving signal and a waveform file of a chromatic driving signal. The at least two second waveform file groups respectively correspond to the at least two second temperature ranges. In the case where the colors of the image to be displayed include the black color, the white color and the chromatic color, the at least one processor is configured to: according to the waveform file of the second black driving signal in the second waveform file group corresponding to the second temperature range which the ambient temperature is in, control the source driver to output the second black driving signal to the pixel to be displayed in the black color in the electronic ink screen; according to the waveform file of the second white driving signal in the second waveform file group corresponding to the second temperature range which the ambient temperature is in, control the source driver to output the second white driving signal to the pixel to be displayed in the white color in the electronic ink screen; and according to the waveform file of the chromatic driving signal in the second waveform file group corresponding to the second temperature range which the ambient temperature is in, control the source driver to output the chromatic driving signal to the pixel to be displayed in the chromatic color in the electronic ink screen.

In some embodiments, the first black driving signal and the first white driving signal each include sub-signals of M phases; and the second black driving signal, the second white driving signal and the chromatic driving signal each include sub-signals of N phases; N is greater than M. The second black driving signal includes sub-signals of M phases that are the same as the sub-signals of M phases included in the first black driving signal, and the second white driving signal includes sub-signals of M phases that are the same as the sub-signals of M phases included in the first white driving signal.

In some embodiments, the display control apparatus further includes a gate driver. The at least one processor is further configured to: control the gate driver to sequentially scan rows of pixels in the electronic ink screen in an i-th display driving phase of displaying the image to be displayed; control the source driver to output a sub-signal of an i-th phase in the first black driving signal to the pixel to be displayed in the black color in each row of pixels that is scanned, and to output a sub-signal of an i-th phase in the first white driving signal to the pixel to be displayed in the white color in each row of pixels that is scanned; wherein i is greater than or equal to 1 and less than or equal to M ($1 \leq i \leq M$). And/or, the at least one processor is further configured to: control the gate driver to sequentially scan the rows of pixels in the electronic ink screen in a j-th display driving phase of displaying the image to be displayed; control the source driver to output a sub-signal of a j-th phase in the second black driving signal to the pixel to be displayed in the black color in each row of pixels that is scanned, to output a sub-signal of a j-th phase in the second white driving signal to the pixel to be displayed in the white color in each row of pixels that is scanned, and to output a sub-signal of a j-th phase in the chromatic driving signal to the pixel to be displayed in the chromatic color in each row of pixels that is scanned; wherein j is greater than or equal to 1 and less than or equal to N ($1 \leq j \leq N$).

In some embodiments, the at least one processor is further configured to obtain the image to be displayed and determine whether the image to be displayed includes chromatic pixel data; if the image to be displayed includes the chromatic pixel data, the colors of the image to be displayed include the black color, the white color and the chromatic color; and if the image to be displayed does not include the chromatic pixel data, the colors of the image to be displayed include only the black color and the white color. Alternatively, the at least one processor is further configured to receive a display mode control instruction configured to indicate that the colors of the image to be displayed include only the black color and the white color, or include the black color, the white color and the chromatic color.

In yet another aspect, an electronic ink display apparatus is provided. The electronic ink display apparatus includes an electronic ink display screen and the display control apparatus as described in any of the above embodiments.

In yet another aspect, a computer-readable storage medium is provided. The computer-readable storage medium has stored computer program instructions that, when run on an electronic ink display apparatus, cause the electronic ink display apparatus to perform the control method for the electronic ink screen as described in any of the above embodiments.

In yet another aspect, a non-transitory computer-readable storage medium is provided. The non-transitory computer-readable storage medium has stored computer program instructions that, when run on a processor, cause the processor to perform one or more steps of the control method for the electronic ink screen as described in any of the above embodiments.

In yet another aspect, a computer program product is provided. The computer program product includes computer program instructions that, when run on a computer, cause the computer (e.g., an electronic ink display apparatus) to perform one or more steps of the control method for the electronic ink screen as described in any of the above embodiments.

In yet another aspect, a computer program is provided. When run on a computer, the computer program causes the computer (e.g., an electronic ink display apparatus) to perform one or more steps of the control method for the electronic ink screen as described in any of the above embodiments.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art can obtain other drawings according to these drawings. In addition, the accompanying drawings in the following description may be regarded as schematic diagrams, and are not limitations on actual sizes of products, actual processes of methods and actual timings of signals involved in the embodiments of the present disclosure.

DETAILED DESCRIPTION

Figure 1:
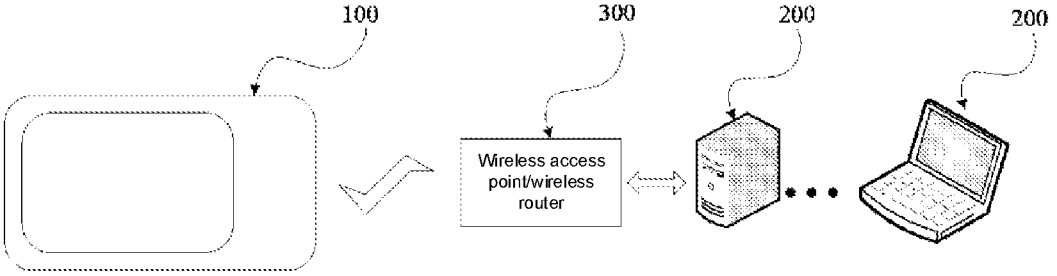
FIG. 1 is a structural diagram of a system architecture using an electronic ink display apparatus, in accordance with some embodiments of the present disclosure.

Technical solutions in some embodiments of the present disclosure will be described clearly and completely with reference to the accompanying drawings below. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive meaning, i.e., "including, but not limited to". In the description of the specification, the terms such as "one embodiment", "some embodiments", "exemplary embodiments", "example", "specific example" and "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms such as "first" and "second" are used for descriptive purposes only, and are not to be construed as indicating or implying the relative importance or implicitly indicating the number of indicated technical features. Thus, a feature defined with "first" or "second" may explicitly or implicitly include one or more of the features. In the description of the embodiments of the present disclosure, "a plurality of/the plurality of" means two or more unless otherwise specified.

The phrase "applicable to" or "configured to" used herein means an open and inclusive expression that does not exclude devices that are applicable to or configured to perform additional tasks or steps.

Additionally, the phrase "based on" used is meant to be open and inclusive, since a process, step, calculation, or other action that is "based on" one or more of the stated conditions or values may, in practice, be based on additional conditions or values beyond those stated.

Exemplary embodiments are described herein with reference to sectional views and/or plan views as idealized exemplary drawings. In the drawings, thicknesses of layers and sizes of regions are enlarged for clarity. Thus, variations in shape relative to the accompanying drawings due to, for example, manufacturing technologies and/or tolerances may be envisaged. Therefore, the exemplary embodiments should not be construed as being limited to the shapes of the regions shown herein, but including shape deviations due to, for example, manufacturing. For example, an etched region shown in a rectangular shape generally has a feature of being curved. Therefore, the regions shown in the accompanying drawings are schematic in nature, and their shapes are not intended to show actual shapes of regions in a device, and are not intended to limit the scope of the exemplary embodiments.

Electronic ink display apparatuses are widely favored by consumers due to many advantages thereof. However, the electronic ink display apparatus is generally powered by a battery (e.g., a button cell) installed therein; and in view of a limited capacity of the battery (a small capacity of the button cell), there is a problem of how to reduce power consumption of the electronic ink display apparatus to increase a service life of the battery.

In order to solve the problem, referring to FIG. 1, some embodiments of the present disclosure provide a system architecture using an electronic ink display apparatus. The system architecture includes the electronic ink display apparatus 100 and communication opposite-end device(s) 200, the electronic ink display apparatus 100 and the communication opposite-end device 200 may be communicatively connected to each other. The communication opposite-end device 200 is configured to control an image (i.e., a picture) displayed on the electronic ink display apparatus 100. In some embodiments, the electronic ink display apparatus 100 may establish a connection with the communication opposite-end device 200 by means of wireless communication (such as Wi-Fi or bluetooth). For example, the communication opposite-end device 200 is connected to a wireless router or a wireless access point (AP) 300 by means of wireless communication or wire communication, and the electronic ink display apparatus 100 is connected to the wireless access point 300 by means of wireless communication, so as to be communicatively connected to the communication opposite-end device 200. Of course, the embodiments are not limited to such a communication connection. For example, the communication opposite-end device 200 may also establish a connection with the electronic ink display apparatus 100 by means of wire communication.

The electronic ink display apparatus 100 may be applied to various scenes. For example, the electronic ink display apparatus 100 may be an electronic reader, a smart label (also referred to as an electronic tag), an electronic timepiece (e.g., an electronic watch), a thermometer, a bus stop sign, a fuel price sign at a fuel station, or the like. Smart labels may include electronic shelf labels placed on shelves of supermarkets, convenience stores, pharmacies and the like, luggage labels, and drug labels disposed on drug packages, etc.

Figure 2:
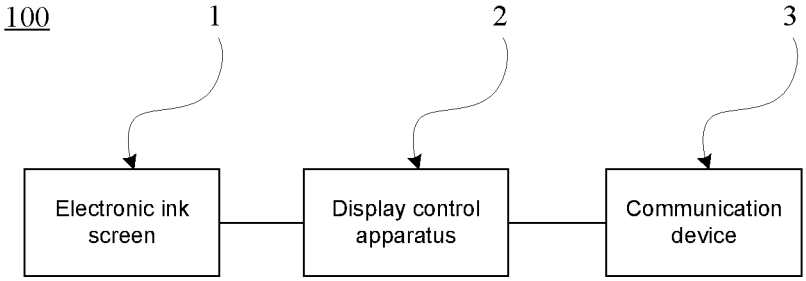
FIG. 2 is a structural diagram of an electronic ink display apparatus, in accordance with some embodiments of the present disclosure.

Referring to FIG. 2, the electronic ink display apparatus 100 may include an electronic ink screen 1, a display control apparatus 2 and a communication device 3. The electronic ink screen 1 and the communication device 3 are both connected to the display control apparatus 2.

Figure 3:
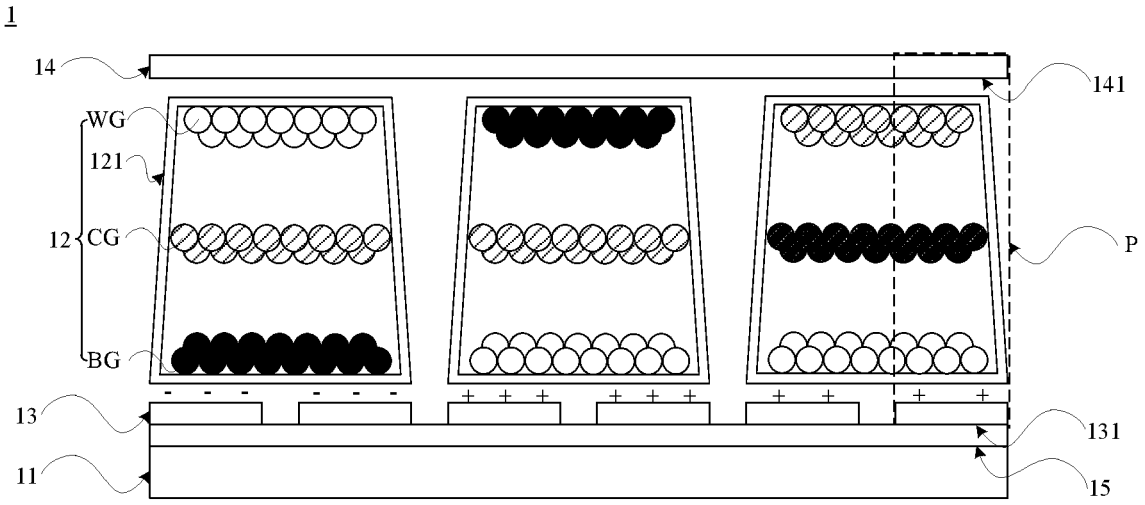
FIG. 3 is a structural diagram of an electronic ink screen, in accordance with some embodiments of the present disclosure.

Referring to FIG. 3, in some embodiments, the electronic ink screen 1 includes a substrate 11, and an electronic ink film 12, a first electrode layer 13 and a second electrode layer 14 that are all disposed on the substrate 11. The first electrode layer 13 and the second electrode layer 14 are disposed on opposite sides of the electronic ink film in a thickness direction of the substrate 11, and the first electrode layer 13 is closer to the substrate 11 than the second electrode layer 14. Generally, the second electrode layer 14 is closer to a display surface of the electronic ink screen 1 than the first electrode layer 13. The electronic ink film 12 includes a plurality of microstructures 121, such as microcups or microcapsules. Each microstructure 121 includes a transparent liquid and types of charged particles. For example, the types of charged particles include charged white particles WG, charged black particles BG and charged chromatic particles CG. The white particles WG may be negatively charged, and the black particles BG and the chromatic particles CG may be positively charged. By supplying power to the first electrode layer 13 and the second electrode layer 14, an electric field formed between the first electrode layer 13 and the second electrode layer 14 can drive the charged particles in each microstructure 121 to move, so as to control the type of charged particles suspended at a position proximate to the display surface in each microstructure 121 (on a top of the microstructure 121 in FIG. 3), thereby controlling a color displayed by each microstructure 121. Thus, the electronic ink screen 1 can display an image. The chromatic particles CG may be particles with any color other than a black color and a white color. For example, the chromatic particles CG may be red particles RG.

Referring to FIG. 3, the electronic ink film 12, the first electrode layer 13 and the second electrode layer 14 in the electronic ink screen 1 may constitute a plurality of pixels P. For example, the plurality of pixels P may be distributed in an array. That is, the electronic ink screen includes the pixels P with S rows multiplied by Q columns, where S is greater than or equal to 2 ($S \geq 2$), and Q is greater than or equal to 2 ($Q \geq 2$). Correspondingly, the first electrode layer 13 may include a plurality of first electrodes (which are also referred to as pixel electrodes) 131 distributed at intervals; the second electrode layer 14 may include a plurality of second electrodes (which are also referred to as common electrodes) 141 opposite to the positions where the plurality of first electrodes 131 are located. The plurality of second electrodes 141 may be electrically connected to each other. For example, the second electrode layer 14 may be a whole electrode layer containing only one closed contour line. As an example, a single pixel P may include one first electrode 131 and one or more microstructures 121 (e.g., one microstructure 121); or as shown in FIG. 3, one microstructure 121 may be distributed in two adjacent pixels P.

In this way, the display control apparatus 2 may apply a voltage signal (which may be referred to as a COM voltage) to the second electrode layer 14, and in a process of refreshing an image displayed by the electronic ink screen 1, the display control apparatus 2 may, according to pixel data of each pixel P, apply a corresponding data driving signal to the first electrode 131 included in the pixel P. For example, if pixel data of a pixel P is white pixel data, a white driving signal is applied to the first electrode 131 of the pixel P, so that the white particles WG in the pixel P are suspended at the position proximate to the display surface after the image is refreshed, and the pixel P displays the white color; if pixel data of a pixel P is black pixel data, a black driving signal is applied to the first electrode 131 of the pixel P, so that the black particles BG in the pixel P are suspended at the position proximate to the display surface after the image is refreshed, and the pixel P displays the black color; and if pixel data of a pixel P is chromatic pixel data (e.g., red pixel data), a chromatic driving signal (e.g., a red driving signal) is applied to the first electrode 131 of the pixel P, so that the chromatic particles CG (e.g., the red particles RG) in the pixel P are suspended at the position proximate to the display surface after the image is refreshed, and the pixel P displays a chromatic color (e.g., a red color).

Figure 4:
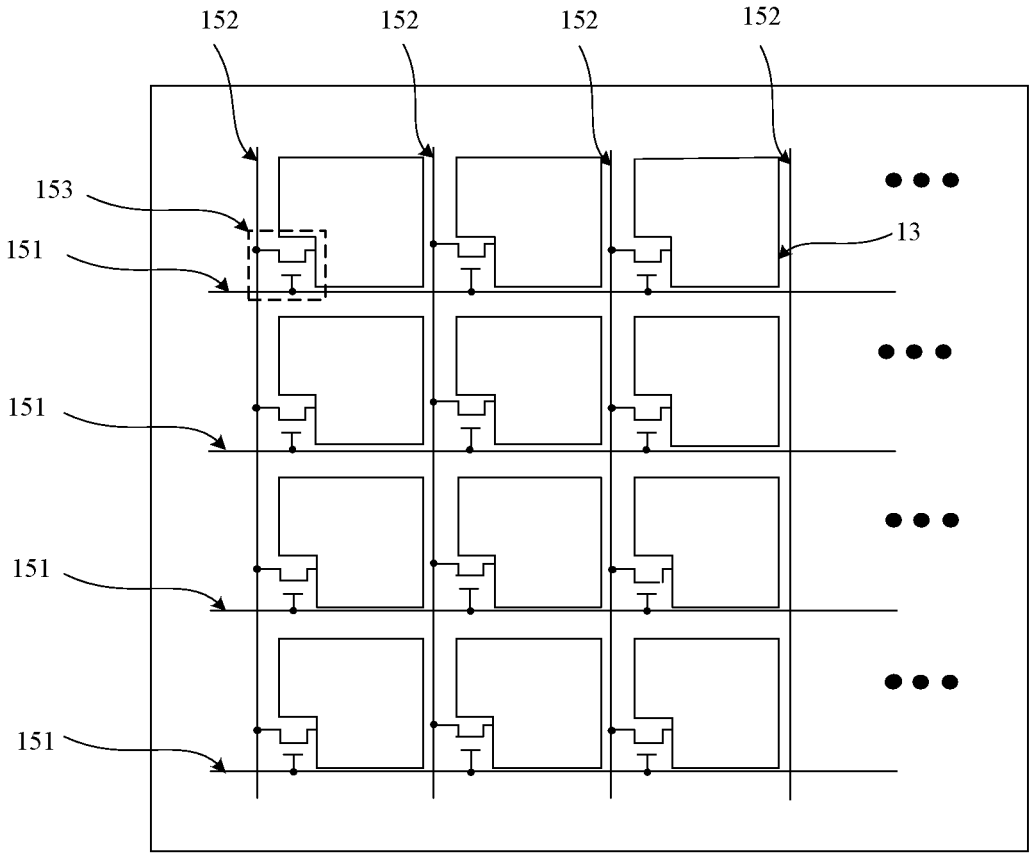
FIG. 4 is a structural diagram showing a connection between a pixel driving circuit and a pixel electrode, in accordance with some embodiments of the present disclosure.

In some embodiments, referring to FIG. 3, the electronic ink screen 1 may further include a pixel driving circuit 15 disposed on the substrate 11, so as to apply data driving signals to the first electrodes 131 in the first electrode layer 13, respectively. Referring to FIG. 4, the pixel driving circuit 15 may include a plurality of gate lines 151 and a plurality of data lines 152. The plurality of gate lines 151 and the plurality of data lines 152 are arranged crosswise, e.g., arranged perpendicular to each other. The pixel driving circuit 15 may further include switching devices 153 each connected to the gate line 151 and the data line 152 that cross. For example, the switching devices 153 may be thin film transistors (TFTs). The display control apparatus 2 is connected to the plurality of gate lines 151 to input scanning signals to the plurality of gate lines 151, so as to control gating of the rows of pixels P connected to the plurality of gate lines 151. For example, the display control apparatus 2 may scan the rows of pixels P row by row, that is, the display control apparatus 2 may input the scanning signals to the plurality of gate lines 151 row by row in an order from a first gate line to a last gate line, so that switching devices 153 connected to the scanned gate line 151 are in an on state. The display control apparatus 2 is connected to the plurality of data lines 152 to input data driving signals to the first electrodes 131 of a row of pixels P that is gated (scanned), so that the pixels P each display a corresponding color under action of an electric field. For example, the second electrode layer 14 may be provided a signal of 0V, and a data driving signal in a range from −15V to 15V may be inputted to the first electrode 131, so that a magnitude of an electric field where a pixel P is located may be controlled.

The electronic ink screen 1 has a bistable characteristic, and even if the electric field is cancelled, the electronic ink screen 1 can still display the last refreshed image. As a result, the electronic ink screen 1 does not need to be continuously powered to maintain the image, and thus the electronic ink display apparatus 100 may achieve low power consumption.

Figure 5:
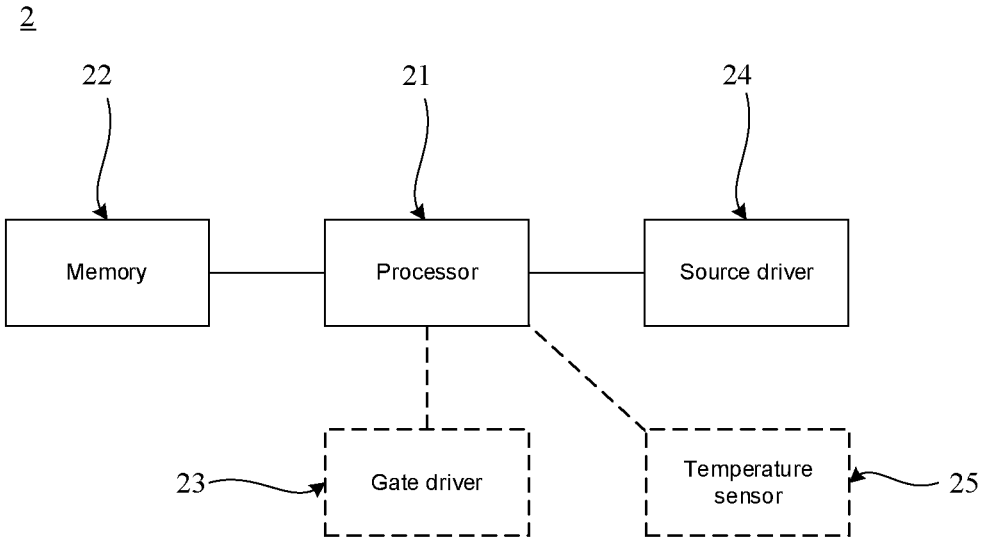
FIG. 5 is a structural diagram of a display control apparatus, in accordance with some embodiments of the present disclosure.

In some embodiments, referring to FIG. 5, the display control apparatus 2 includes at least one processor 21, at least one memory 22, a gate driver 23 (optional) and a source driver 24.

The gate driver 23, which may also be referred to as a gate driving circuit, is configured to output the scanning signals to the electronic ink screen 1 under control of the at least one processor 21, so as to control the gating of the rows of pixels. The gate driver 23 may be disposed in the display control apparatus 2 or in the electronic ink screen 1, which is not limited in the embodiments. For example, the gate driver 23 is disposed in the display control apparatus 2.

The source driver 24, which may also be referred to as a source driving circuit, is configured to output the data driving signals to the electronic ink screen 1 under the control of the at least one processor 21, so as to control the color displayed by the pixel.

For example, the gate driver 23 and/or the source driver 24 may send a BUSY signal to the processor 21 to inform the processor 21 of a state of itself (the gate driver 23 and/or the source driver 24). The processor 21 may determine whether to send a command or data to the gate driver 23 and/or the source driver 24 according to the BUSY signal. The processor 21 sends a clock (CLK) signal to the gate driver 23 and the source driver 24 to provide the gate driver 23 and the source driver 24 with a clock required for their operations. In addition, the processor 21 may also send a direct current (DC) signal to the gate driver 23 and the source driver 24 to inform the gate driver 23 and/or the source driver 24 of what to be sent next is a command or data. The source driver 24 may include a plurality of source driving sub-circuits, and the processor 21 may send a chip select (CS) signal to one of the plurality of source driving sub-circuits, so as to select the source driving sub-circuit for signal transmission. For example, the processor 21 may send a start scanning command to the gate driver 23, so as to start scanning the first gate line of the electronic ink screen; and the processor 21 may also send the data driving signals (i.e., data) to the source driver 24.

The memory 22 may store computer program(s) and data. The memory 22 may include a high-speed random access memory. The memory 22 may also include a non-volatile memory, such as a magnetic disk storage device or a flash memory device. The memory 22 may also be a read-only memory (ROM) or any other type of static storage device that may store static information and instruction(s), a random access memory (RAM) or any other type of dynamic storage device that may store information and instruction(s). The memory 22 may also be a one-time programmable (OTP) memory, an electrically erasable programmable read-only memory (EEPROM), a disk storage medium or any other magnetic storage device, or any other medium that can be used to carry or store program codes in a form of instructions or data structures and can be accessed by a computer, but it is not limited thereto. The memory 22 may be provided separately and connected to the processor 21 through a communication line. The memory may also be integrated with the processor 21.

The at least one processor 21 is connected to the gate driver 23, the source driver 24 and the at least one memory 22, and calls data in the memory 22 to control the gate driver 23 and the source driver 24 to output corresponding signals by running or executing computer program(s) stored in the memory 22. The at least one processor 21 may be one or more general-purpose central processing units (CPUs), microcontroller units (MCUs), logic devices, application-specific integrated circuits (ASICs) or integrated circuits for controlling execution of program(s) in some embodiments of the present disclosure. The CPU may be a single-CPU or a multi-CPU. The processor 21 herein may refer to one or more devices, circuits or processing cores for processing data (e.g., computer program instructions).

With continued reference to FIG. 5, the display control apparatus 2 may further include a temperature sensor 25 connected to the at least one processor 21. The temperature sensor 25 is configured to measure an ambient temperature and send the ambient temperature to the at least one processor 21, so that the at least one processor 21 controls the source driver 24 to output data driving signals corresponding to the ambient temperature according to the ambient temperature.

Figure 6:
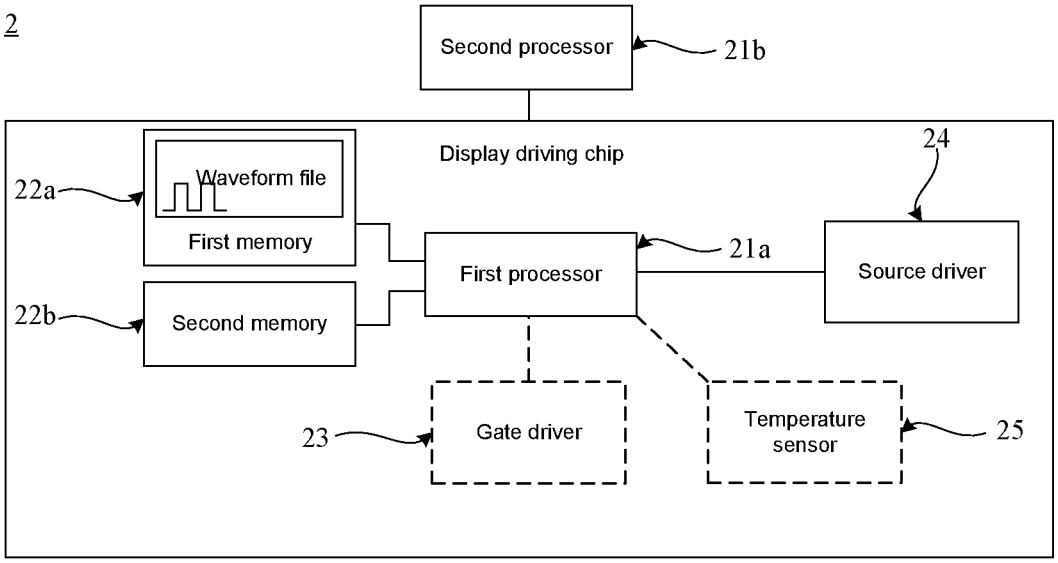
FIG. 6 is a structural diagram of another display control apparatus, in accordance with some embodiments of the present disclosure.

In some other embodiments, referring to FIG. 6, the at least one processor 21 in the display control apparatus 2 may include a first processor 21*a* and a second processor 21*b*. As an example, the first processor 21*a* is a logic device, and the second processor 21*b* may be a microprocessor. Compared with the microprocessor, the logic device may not contain a function of data sending. The at least one memory 22 may include a first memory 22*a* and a second memory 22*b*. As an example, the first memory 22*a* is a one-time programmable memory, and the second memory 22*b* is a random access memory. As an example, the first processor 21*a* may realize its function by running computer program(s) stored in the first memory 22*a*.

For example, the first processor 21*a*, the first memory 22*a*, the second memory 22*b*, the gate driver 23, the source driver 24 and the temperature sensor 25 may be integrated together as a display driving chip. The display driving chip is electrically connected to the second processor 21*b* through a serial peripheral interface (SPI).

In some embodiments, the communication device 3 is a device for information interaction with an external device (the AP or the wireless router). The communication device 3 is connected to the at least one processor 21 (e.g., the second processor 21*b*), so as to send data or commands to the external device or to receive data or commands sent by the external device under the control of the processor 21. The communication device 3 may be a transceiver, a transceiver circuit, a transmitter, a receiver, or the like. For example, the communication device 3 may be a wireless communication device such as a wireless-fidelity (Wi-Fi) device or a bluetooth device, or a wired communication device such as a universal serial bus (USB) interface. The Wi-Fi device provides the electronic ink display apparatus 100 with network access following a standard protocol related to the Wi-Fi. The bluetooth device may be an integrated circuit or a bluetooth chip. As an example, the communication device 3 and the processor 21 may be provided separately or integrated together. For example, the communication device 3 may be integrated with the second processor 21*b*.

In some embodiments, the communication opposite-end device 200 may be a server or a terminal. The terminal may be a personal computer (PC), such as a desktop computer, a notebook computer, a tablet computer or an ultrabook. The terminal may also be a handhold terminal such as a mobile phone.

Figure 7:
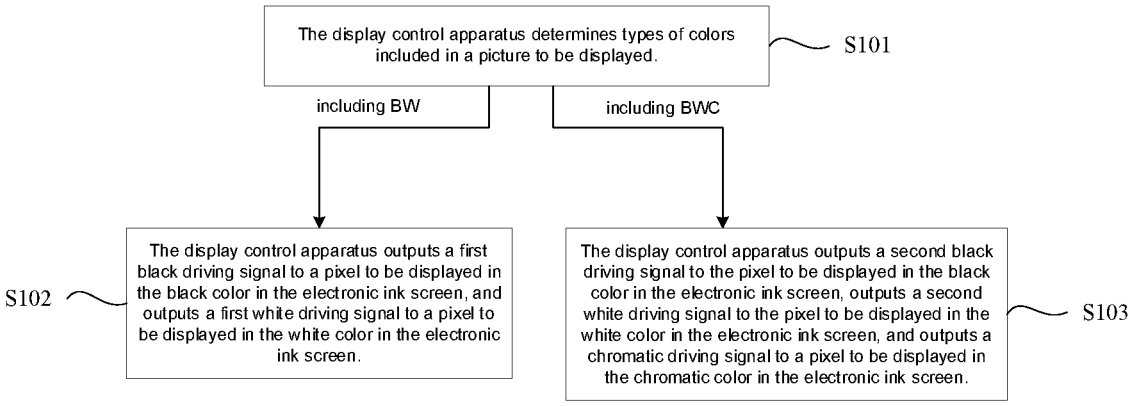
FIG. 7 is a flow diagram of a control method for an electronic ink screen, in accordance with some embodiments of the present disclosure.

Based on the electronic ink display apparatus as described above, some embodiments of the present disclosure provide a control method for the electronic ink screen 1. An execution subject of the control method may be the display control apparatus 2, or a product including the display control apparatus 2 such as the electronic ink display apparatus 100. As shown in FIG. 7, in an example where the display control apparatus 2 is the execution subject, the control method may include following steps S101 to S103.

In S101, the display control apparatus determines types of colors included in an image to be displayed.

Figure 8:
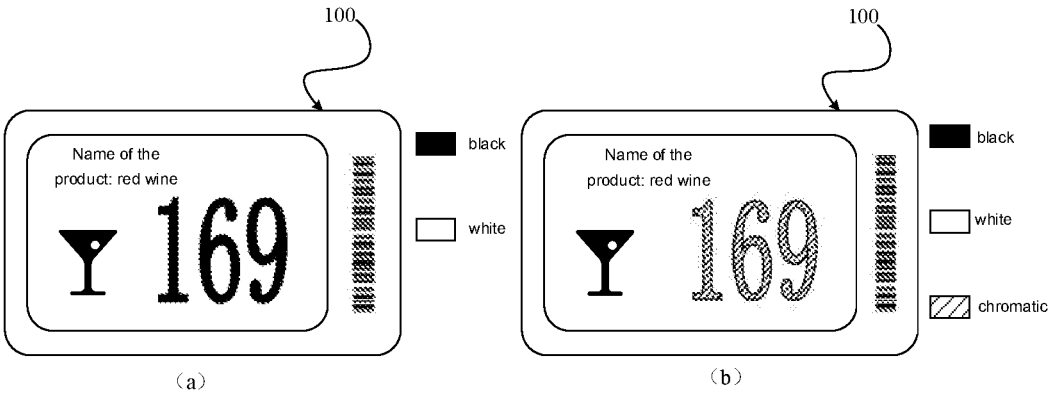
FIG. 8 is a diagram showing structures of electronic shelf labels, in accordance with some embodiments of the present disclosure.

For example, the electronic ink display apparatus 100 is used as an electronic shelf label. The image to be displayed of the electronic shelf label may be regarded as an image that has been input into the electronic shelf label but has not been displayed yet. It may be an image as shown in (a) of FIG. 8, which includes only two colors, i.e., a black color and a white color. That is, the image to be displayed includes only black pixel data and white pixel data. Alternatively, it may be an image as shown in (b) of FIG. 8, which includes three colors, i.e., the black color, the white color and a chromatic color (e.g., a red color). That is, the image to be displayed includes black pixel data, white pixel data and chromatic pixel data.

The image to be displayed includes a plurality of pixel data, and each pixel data may be composed of two bits of data, which determine a color displayed by a pixel corresponding to the pixel data in the electronic ink screen 1. If a pixel corresponding to pixel data displays the black color, the pixel data is referred to as black pixel data; and correspondingly, white pixel data and chromatic pixel data each have a similar meaning. For example, the pixel data include four forms, i.e., 00, 01, 10 and 11. 00 represents the black pixel data, 01 represents the white pixel data, and 10 and 11 each represent the chromatic pixel data. That is, when a first bit of pixel data is 1, the pixel data is the chromatic pixel data, otherwise the pixel data is the black pixel data or the white pixel data.

In some embodiments, S101 may include following steps.

Firstly, the display control apparatus 2 obtains the image to be displayed.

For example, the communication opposite-end device 200 may send the image to be displayed to the electronic ink display apparatus 100 through the wireless router or the wireless access point (AP) 300. In the electronic ink display apparatus 100, the at least one processor 21 shown in FIG. 5 may receive the image to be displayed through the communication device 3 and store it in the at least one memory 22. For example, referring to FIG. 6, the second processor 21*b* in the display control apparatus 2 may obtain the image to be displayed through the communication device 3 and send the image to be displayed to the first processor 21*a*. The first processor 21*a* receives the image to be displayed and stores it in the second memory 22*b*.

Figure 9:
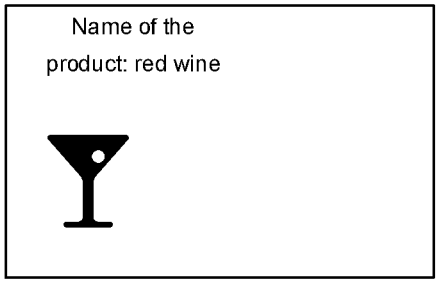
FIG. 9 is a diagram of a template image of an electronic shelf label, in accordance with some embodiments of the present disclosure.

For another example, the at least one memory 22 shown in FIG. 5 may store one or more images, which may be, for example, template image(s). For the electronic shelf label, the template image may include a sub-image for displaying a fixed content (i.e., a non-adjustable content) and a sub-image for displaying a variable content (i.e., an adjustable content). The fixed content may include a supermarket name, a discount reminder or other content applicable to different categories, and the variable content may include a category, price information and other content. The sub-image for displaying the variable content may be a white sub-image. For example, FIG. 9 shows a template image of a merchandise category (e.g., red wine). The at least one processor 21 may read the template image as the image to be displayed, so as to drive the electronic ink screen 1 to display the template image according to subsequent steps. Of course, after the at least one processor 21 receives information containing variable content to be displayed sent by the communication opposite-end device 200 through the communication device 3, the at least one processor 21 may update the template image according to information of the variable content to generate an updated image to be displayed. The image to be displayed includes a sub-image for displaying the fixed content and a sub-image capable of presenting the variable content to be displayed. The new image to be displayed may also be stored in the at least one memory 22 (e.g., the second memory 22*b*).

Secondly, the display control apparatus 2 determines whether the image to be displayed includes chromatic pixel data. If the image to be displayed includes the chromatic pixel data, colors of the image to be displayed include the black color, the white color and the chromatic color. If the image to be displayed does not include the chromatic pixel data, the colors of the image to be displayed include only the black color and the white color.

For example, the at least one processor 21 in FIG. 5 may determine whether the image to be displayed includes chromatic pixel data either before or after storing the image to be displayed in the at least one memory 22. For example, it may be that the second processor 21*b* in FIG. 6 determines whether the image to be displayed includes chromatic pixel data after obtaining the image to be displayed and sends the determined result to the first processor 21*a*, so that the first processor 21*a* may perform subsequent steps according to the determined result. It may also be that the first processor 21*a* in FIG. 6 determines whether the image to be displayed includes chromatic pixel data after obtaining the image to be displayed. In an example where the pixel data includes four forms, i.e., 00, 01, 10 and 11, it may be determined whether the pixel data is chromatic pixel data as long as the first bit of the pixel data is determined. In a case where the image to be displayed includes at least one chromatic pixel data (for example, the first bit of at least one pixel data is 1), the colors of the image to be displayed include the black color, the white color and the chromatic color. In a case where the image to be displayed does not include chromatic pixel data (for example, first bits of all pixel data are 0), the colors of the image to be displayed include only the black color and the white color.

In some other embodiments, the display control apparatus 2 receives a display mode control instruction configured to indicate that the colors of the image to be displayed include only the black color and the white color, or include the black color, the white color and the chromatic color.

For example, since the communication opposite-end device 200 controls the image to be displayed of the electronic ink display apparatus 100, communication opposite-end device 200 may determine whether the image to be displayed includes chromatic pixel data, generate the display mode control instruction according to the determined result and send the display mode control instruction to the electronic ink display apparatus 100. For example, if the image to be displayed includes chromatic pixel data, a field in the display mode control instruction is 1; if the image to be displayed does not include chromatic pixel data, the field in the display mode control instruction is 0. The display control apparatus 2 (e.g., the at least one processor 21 in the display control apparatus 2) may receive the display mode control instruction sent by the communication opposite-end device 200 through the communication device 3, and determine the types of the colors included in the image to be displayed.

Next, in a case where the colors of the image to be displayed include only the black color and the white color, S102 is performed; in a case where the colors of the image to be displayed include the black color, the white color and the chromatic color, S103 is performed.

In S102, the display control apparatus outputs a first black driving signal to a pixel to be displayed in the black color in the electronic ink screen, and outputs a first white driving signal to a pixel to be displayed in the white color in the electronic ink screen.

The pixel to be displayed in the black color refers to a pixel corresponding to black pixel data in the image to be displayed, and the pixel to be displayed in the white color refers to a pixel corresponding to white pixel data in the image to be displayed.

Figure 10:
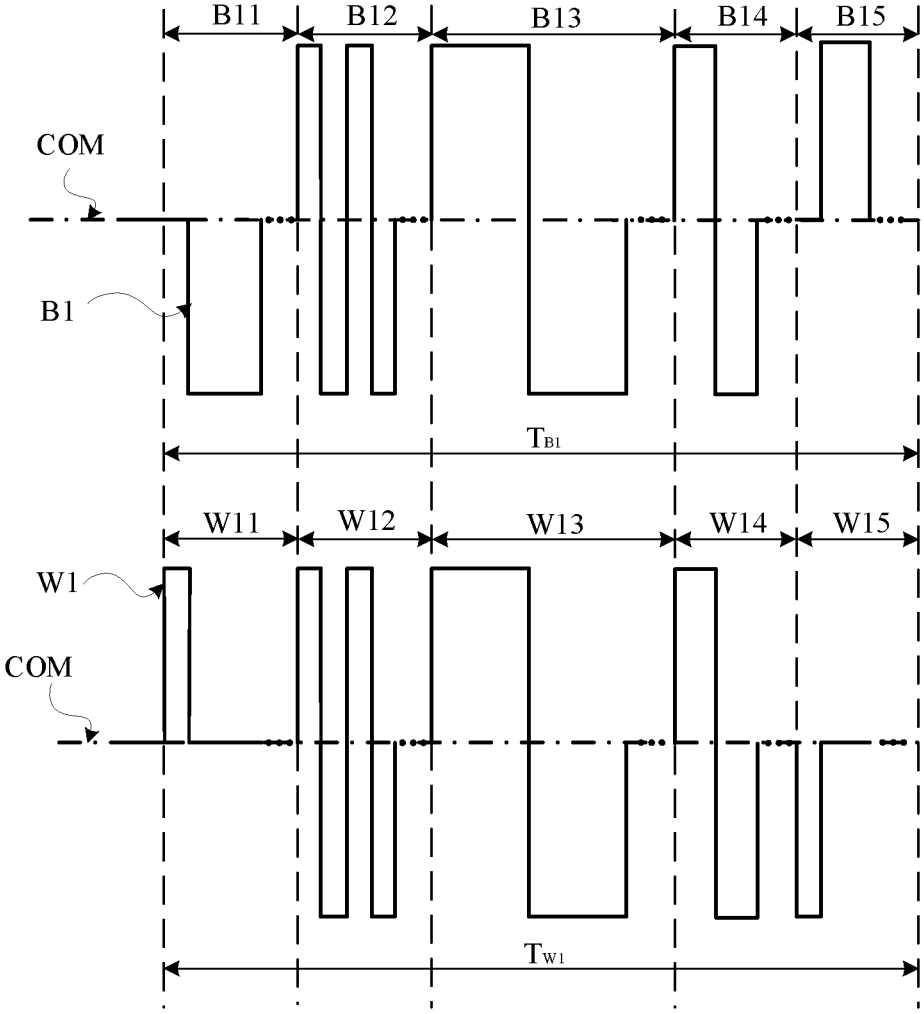
FIG. 10 is a diagram showing a first black driving signal and a first white driving signal in a control method for an electronic ink screen, in accordance with some embodiments of the present disclosure.

In a process of displaying the image to be displayed (i.e., refreshing the image once), in order to synchronize refresh processes of pixels to be displayed in different colors, as shown in FIG. 10, a duration $T_{B1}$ of the first black driving signal B1 is equal to or approximately equal to a duration $T_{W1}$ of the first white driving signal W1.

Each pixel includes charged particles of three colors, i.e., the black particles, the white particles and the chromatic particles. For normal display, the particles of the three colors in each pixel may be moved by a change of the data driving signal applied to the first electrode of the pixel, so that the particles of the three colors in the pixel may be separated to be at different positions. In some embodiments, the first black driving signal B1 and the first white driving signal W1 shown in FIG. 10 each include sub-signals of M phases, where M is greater than or equal to 1 ($M \geq 1$). For example, M is greater than or equal to 2 ($M \geq 2$). For example, M is equal to 5 ($M=5$). For example, durations of the sub-signals of M phases may be the same or different. The embodiments of the present disclosure are illustrated by taking an example in which the durations of the sub-signals of M phases are different.

In some embodiments, in a case where the M is equal to 5 ($M=5$), the sub-signals from a first phase to a fifth phase included in the first black driving signal B1 are sequentially: a black pull-down signal B11, a first rectangular wave B12, a second rectangular wave B13, a third rectangular wave B14 and a black push-up signal B15.

The black pull-down signal B11 is configured to drive the black particles in the pixel to move to a side away from the display surface of the electronic ink screen, so as to balance running (movement) of the black particles. The first rectangular wave B12, a frequency of which is a first frequency, makes the black particles wobble in advance. The second rectangular wave B13, a frequency of which is a second frequency, makes the black particles continue to wobble. The third rectangular wave B14, a frequency of which is a third frequency, makes the black particles continue to wobble to separate the black particles and the chromatic particles (e.g., red particles). The black push-up signal B15 is configured to drive the black particles in the pixel to move to a side proximate to the display surface of the electronic ink screen, so that the pixel displays the black color. The first frequency is greater than the third frequency, and the third frequency is greater than the second frequency.

In some embodiments, in the case where the M is equal to 5 ($M=5$), the sub-signals from a first phase to a fifth phase included in the first white driving signal W1 are sequentially: a white pull-down signal W11, a fourth rectangular wave W12, a fifth rectangular wave W13, a sixth rectangular wave W14 and a white push-up signal W15.

Charge polarity of the black particles is different from charge polarity of the white particles. Thus, in a case where it needs to make the black particles and the white particles move in the same direction, a direction of a signal applied to the black particles is different from a direction of a signal applied to the white particles. For example, in a case where the black particles are positively charged and the white particles are negatively charged, as shown in FIG. 10, a direction of the black push-up signal B15 is opposite to a direction of the white push-up signal W15.

The white pull-down signal W11 is configured to drive the white particles in the pixel to move to the side away from the display surface of the electronic ink screen, so as to balance running (movement) of the white particles. The fourth rectangular wave W12, a frequency of which is a fourth frequency, makes the white particles wobble in advance. The fifth rectangular wave W13, a frequency of which is a fifth frequency, makes the white particles continue to wobble. The sixth rectangular wave W14, a frequency of which is a sixth frequency, makes the white particles and the chromatic particles (e.g., the red particles) separate. The white push-up signal W15 is configured to drive the white particles in the pixel to move to the side proximate to the display surface of the electronic ink screen, so that the pixel displays the white color. The fourth frequency is greater than the sixth frequency, and the sixth frequency is greater than the fifth frequency.

In some embodiments, the first frequency is equal to the fourth frequency, the second frequency is equal to the fifth frequency, and the third frequency is equal to the sixth frequency. In this way, a complexity of driving may be simplified.

In some embodiments, an entire process of displaying the image to be displayed may be divided into M display driving phases, and in each display driving phase, only one sub-signal of a corresponding phase in each data driving signal is inputted to each pixel. S102 includes following steps.

In an i-th display driving phase of displaying the image to be displayed, the display control apparatus 2 sequentially scans the rows of pixels in the electronic ink screen 1. For example, the at least one processor 21 (e.g., the first processor 21*a*) in the display control apparatus 2 may control the gate driver 23 to output the scanning signals to the gate lines of the electronic ink screen 1 row by row, i.e., to sequentially gate the rows of pixels in an order from the first row to the last row. Of course, an order of scanning the rows is not limited thereto; for example, it is also possible to scan odd rows of pixels first and then scan even rows of pixels. Where i is greater than or equal to 1 and less than or equal to M ($1 \le i \le M$), that is, i is equal to 1, 2, 3, . . . , M (i=1, 2, 3, . . . , M).

Moreover, the display control apparatus 2 outputs a sub-signal of an i-th phase in the first black driving signal B1 to the pixel to be displayed in the black color in each row of pixels that is scanned, and outputs a sub-signal of an i-th phase in the first white driving signal W1 to the pixel to be displayed in the white color in each row of pixels that is scanned. For example, the at least one processor 21 (e.g., the first processor 21*a*) in the display control apparatus 2 may control the source driver 24 to output corresponding sub-signals to each row of pixels that is scanned. For example, in a second display driving phase, a sub-signal W12 in the first white driving signal W1 is output to the pixel to be displayed in the white color, and a sub-signal B12 in the first black driving signal B1 is output to the pixel to be displayed in the black color.

It can be seen that, in the embodiments, in a process of refreshing a black-and-white image (an image including two colors, i.e., the black color and the white color) once, M display driving phases are required. In each display driving phase, each row of pixels needs to be scanned, and the sub-signals corresponding to the display driving phase are output to each row of pixels. In a first display driving phase, sub-signals corresponding to the first display driving phase are output to each row of pixels; then in a second display driving phase, sub-signals corresponding to the second display driving phase are output to each row of pixels; and so on, until in an M-th display driving phase, sub-signals corresponding to the M-th display driving phase are output to each row of pixels, so that the display of the image to be displayed is completed. In this way, in a case where the number of sub-signals included in the data driving signal changes, there is no need to change a scanning signal and a relevant clock signal.

In some other embodiments, it is also possible to scan the rows of pixels row by row, and when a row of pixels is scanned, a corresponding data driving signal (including M sub-signals) is output to each pixel in the row of pixels; then a next row of pixels is scanned.

In some embodiments, the display control apparatus 2 may store a waveform file LUT WF_B1 of the first black driving signal B1 and a waveform file LUT WF_W1 of the first white driving signal W1. The waveform file is used to represent data of the data driving signal shown in FIG. 10. For example, referring to FIG. 6, the waveform files may be stored in the at least one memory 22 (e.g., the first memory 22*a*) of the display control apparatus 2. The at least one processor 21 (e.g., the first processor 21*a*) of the display control apparatus 2 may, according to the image to be displayed stored in the at least one memory 22 (e.g., the second memory 22*b*) and the waveform files stored in the at least one memory 22 (e.g., the first memory 22*a*), control the source driver 24 to output the first black driving signal corresponding to the waveform file LUT WF_B1 to the pixel to be displayed in the black color in the electronic ink screen and to output the first white driving signal corresponding to the waveform file LUT WF_W1 to the pixel to be displayed in the white color in the electronic ink screen.

Due to a special working principle of the electronic ink screen, the white particles, the black particles and the chromatic particles in the microstructure have different activities at different temperatures, which causes that particles with the same color have different responses to the same data driving signal at different temperatures. Therefore, in order to ensure that the electronic ink screen can work normally at different temperatures, different data driving signals corresponding to different temperatures may be designed for driving the particles with the same color. Herein, different data driving signals mean that at least one of a magnitude of a high level, a magnitude of a low level, a duration of the high level and a duration of the low level in the data driving signals is different.

In some embodiments, referring to Table 1, at least two (e.g., X, where X is greater than or equal to 2 ($X \ge 2$); and Table 1 is illustrated by taking an example in which X is equal to 3 (X=3)) first temperature ranges that are preset respectively correspond to at least two first driving signal groups, and a first driving signal group includes a first black driving signal and a first white driving signal.

For example, the at least two first temperature ranges that are preset respectively correspond to at least two first waveform file groups that are stored, and a first waveform file group includes a waveform file LUT WF_B1 of the first black driving signal and a waveform file LUT WF_W1 of the first white driving signal.

TABLE 1

| Serial number | First temperature range (° C.) | First waveform file group | First driving signal group |
|---|---|---|---|
| 1 | ≤w1 | First waveform file group 1 | First driving signal group 1 |
| 2 | (w1, w2] | First waveform file group 2 | First driving signal group 2 |
| 3 | >w2 | First waveform file group 3 | First driving signal group 3 |

For example, an i-th (1≤i≤X) first temperature range corresponds to a first waveform file group i and a first driving signal group i in the memory 22 (e.g., the first memory 22*a*). The first waveform file group i includes a waveform file LUT WF_B1 and a waveform file LUT WF_W1. For two first waveform file groups, at least one waveform file of the waveform file LUT WF_B1 and the waveform file LUT WF_W1 is different. For example, the waveform file LUT WF_B1 in the first waveform file group 1 is the same as the waveform file LUT WF_B1 in the first waveform file group 2, and the waveform file LUT WF_W1 in the first waveform file group 1 is different from the waveform file LUT WF_W1 in the first waveform file group 2. As another example, the waveform file LUT WF_B1 in the first waveform file group 1 is different from the waveform file LUT WF_B1 in the first waveform file group 3, and the waveform file LUT WF_W1 in the first waveform file group 1 is also different from the waveform file LUT WF_W1 in the first waveform file group 3.

The display control apparatus 2 may, according to a first temperature range which the ambient temperature is in, output the first black driving signal in a corresponding first driving signal group to the pixel to be displayed in the black color in the electronic ink screen 1 and output the first white driving signal in the corresponding first driving signal group to the pixel to be displayed in the white color in the electronic ink screen 1.

For example, the display control apparatus 2 may, according to the waveform file LUT WF_B1 of the first black driving signal in the first waveform file group corresponding to the first temperature range which the ambient temperature is in, output the first black driving signal to the pixel to be displayed in the black color in the electronic ink screen, and according to the waveform file LUT WF_W1 of the first white driving signal in the first waveform file group corresponding to the first temperature range which the ambient temperature is in, output the first white driving signal to the pixel to be displayed in the white color in the electronic ink screen.

For example, the at least one processor 21 (e.g., the first processor 21*a*) in the display control apparatus 2 may obtain the ambient temperature through the temperature sensor 25. If the ambient temperature is in an i-th first temperature range, according to the stored image to be displayed and the waveform file LUT WF_B1 and the waveform file LUT WF_W1 in the first waveform file group i, the at least one processor 21 controls the source driver 24 to output the first black driving signal corresponding to the waveform file LUT WF_B1 in the first waveform file group i (i.e., the first black driving signal in the first driving signal group i) to the pixel to be displayed in the black color, and to output the first white driving signal corresponding to the waveform file LUT WF_W1 in the first waveform file group i (i.e., the first white driving signal in the first driving signal group i) to the pixel to be displayed in the white color.

In S103, the display control apparatus outputs a second black driving signal to a pixel to be displayed in the black color in the electronic ink screen, outputs a second white driving signal to a pixel to be displayed in the white color in the electronic ink screen, and outputs a chromatic driving signal to a pixel to be displayed in the chromatic color in the electronic ink screen.

The pixel to be displayed in the black color refers to a pixel corresponding to the black pixel data in the image to be displayed, the pixel to be displayed in the white color refers to a pixel corresponding to the white pixel data in the image to be displayed, and the pixel to be displayed in the chromatic color refers to a pixel corresponding to the chromatic pixel data in the image to be displayed.

Figure 11:
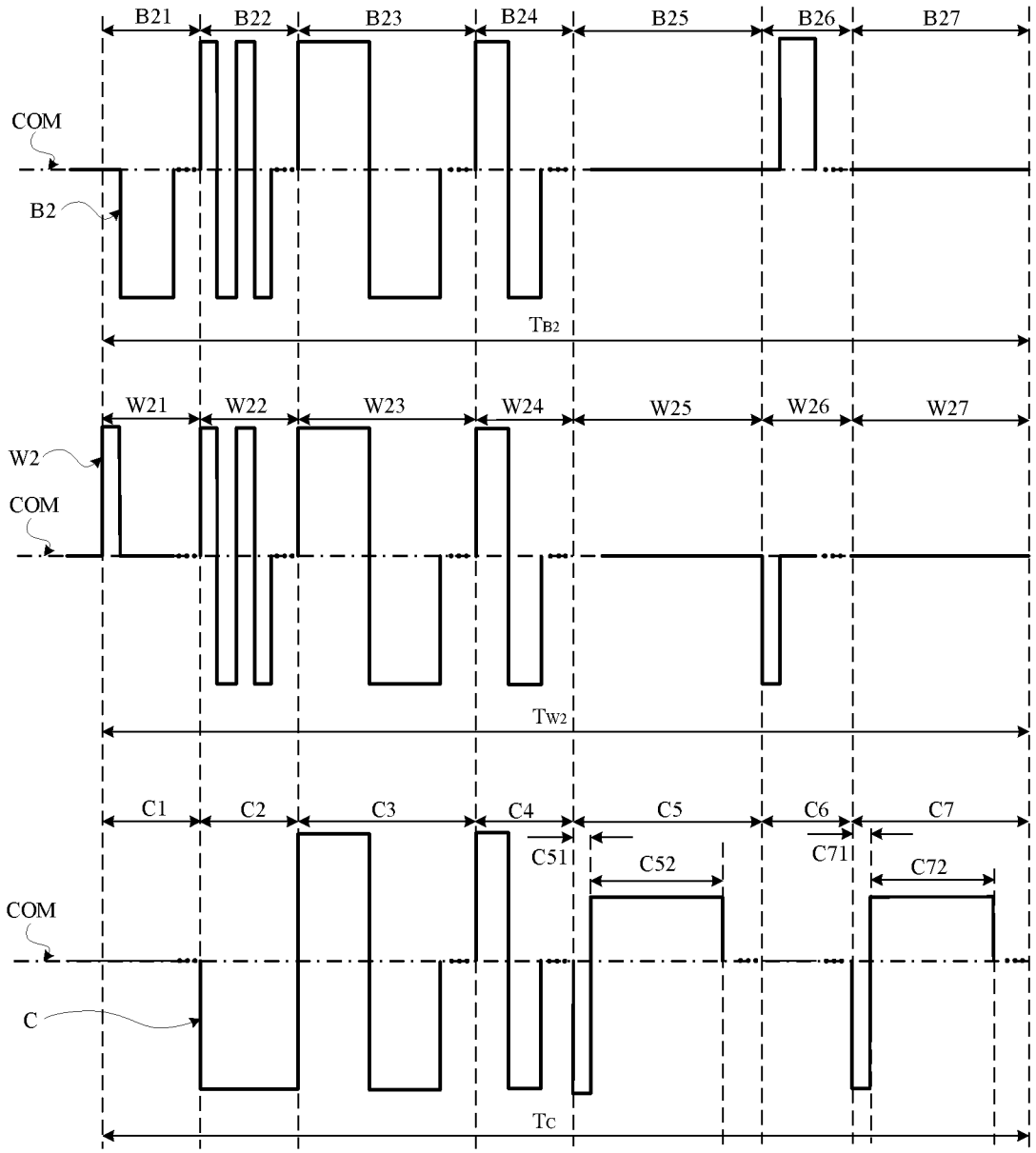
FIG. 11 is a diagram showing a second black driving signal, a second white driving signal and a chromatic driving signal in a control method for an electronic ink screen, in accordance with some embodiments of the present disclosure.

In a process of displaying the image to be displayed, in order to synchronize refresh processes of the pixels to be displayed in different colors, as shown in FIG. 11, a duration $T_{B2}$ of the second black driving signal B2, a duration $T_{W2}$ of the second white driving signal W2 and a duration Tc of the chromatic driving signal C are all equal or approximately equal.

The duration $T_{W2}$ of the second white driving signal W2 is greater than the duration $T_{W1}$ of the first white driving signal W1, correspondingly, the duration $T_{B2}$ of the second black driving signal B2 is greater than the duration $T_{B1}$ of the first black driving signal B1. One of the factors influencing the power consumption of the electronic ink screen is a refresh current and a time corresponding thereto. In the embodiments, in a case where the image to be displayed is a black-and-white image (an image including two colors, i.e., the black color and the white color), a time for refreshing the image once is $T_{W1}$ multiplied by the number of rows of pixels; in a case where the image to be displayed is a chromatic image (an image including three colors, i.e., the black color, the white color and the chromatic color), a time for refreshing the image once is $T_{W2}$ multiplied by the number of rows of pixels. It can be seen that, in the embodiments, different refresh strategies are adaptively executed according to the determined types of colors included in the image to be displayed, so that the time for refreshing the black-and-white image is shorter than the time for refreshing the chromatic image, which can reduce the overall power consumption of the electronic ink display apparatus.

In some embodiments, as shown in FIG. 11, the second black driving signal B2, the second white driving signal W2 and the chromatic driving signal C each include sub-signals of N phases; N is greater than the M. Optionally, N is greater than or equal to 2 (N≥2). For example, N is greater than or equal to 3 (N≥3). For example, N is equal to 7 (N=7). For example, durations of the sub-signals of N phases may be the same or different. The embodiments of the present disclosure are illustrated by taking an example in which the durations of the sub-signals of N phases are different.

In addition, the second black driving signal B2 includes sub-signals of M phases that are the same as the sub-signals of M phases included in the first black driving signal B1, and the second white driving signal W2 includes sub-signals of M phases that are the same as the sub-signals of M phases included in the first white driving signal W2. Thus, the sub-signals in the first black driving signal B1 are fewer than the sub-signals in the second black driving signal B2 by sub-signals of (N−M) phases, so that the duration $T_{B1}$ of the first black driving signal B1 is shorter than the duration $T_{B2}$ of the second black driving signal B2. Similarly, the duration $T_{W1}$ of the first white driving signal W1 is shorter than the duration $T_{W2}$ of the second white driving signal W2.

In some embodiments, as shown in FIG. 11, in a case where N is equal to 7 (N=7), the sub-signals from a first phase to a seventh phase included in the second black driving signal B2 are sequentially: a black pull-down signal B21, a first rectangular wave B22, a second rectangular wave B23, a third rectangular wave B24, an electric field cancellation signal B25, a black push-up signal B26 and an another electric field cancellation signal B27.

The black pull-down signal B21 is configured to drive the black particles in the pixel to move to the side away from the display surface of the electronic ink screen, so as to balance running (movement) of the black particles. The first rectangular wave B22, a frequency of which is a first frequency, makes the black particles wobble in advance. The second rectangular wave B23, a frequency of which is a second frequency, makes the black particles continue to wobble. The third rectangular wave B24, a frequency of which is a third frequency, makes the black particles continue to wobble to separate the black particles and the chromatic particles (e.g., the red particles). The electric field cancellation signal B25 (or B27) is a signal that makes an electric field where the pixel is located zero. That is, a potential of the electric field cancellation signal B25 (or B27) is the same as a potential of the second electrode layer, so that there is no voltage difference between the first electrode in the pixel and the second electrode layer. The black push-up signal B26 is configured to drive the black particles in the pixel to move to the side proximate to the display surface of the electronic ink screen, so that the pixel displays the black color. The first frequency is greater than the third frequency, and the third frequency is greater than the second frequency.

It can be seen that, compared with the second black driving signal B2, the first black driving signal B1 is a data driving signal obtained after removing the electric field cancellation signals in the second black driving signal B2.

In some embodiments, as shown in FIG. 11, in the case where N is equal to 7 (N=7), the sub-signals from a first phase to a seventh phase included in the second white driving signal W2 are sequentially: a white pull-down signal W21, a fourth rectangular wave W22, a fifth rectangular wave W23, a sixth rectangular wave W24, an electric field cancellation signal W25, a white push-up signal W26 and an another electric field cancellation signal W27.

The white pull-down signal W21 is configured to drive the white particles in the pixel to move to the side away from the display surface of the electronic ink screen, so as to balance running (movement) of the white particles. The fourth rectangular wave W22, a frequency of which is a fourth frequency, makes the white particles wobble in advance. The fifth rectangular wave W23, a frequency of which is a fifth frequency, makes the white particles continue to wobble. The sixth rectangular wave W24, a frequency of which is a sixth frequency, makes the white particles and the chromatic particles (e.g., the red particles) separate. The electric field cancellation signal W25 (or W27) is a signal that makes an electric field where the pixel is located zero. That is, a potential of the electric field cancellation signal W25 (or W27) is the same as the potential of the second electrode layer. The white push-up signal W26 is configured to drive the white particles in the pixel to move to the side proximate to the display surface of the electronic ink screen, so that the pixel displays the white color. The fourth frequency is greater than the sixth frequency, and the sixth frequency is greater than the fifth frequency.

It can be seen that, compared with the second white driving signal W2, the first white driving signal W1 is a data driving signal obtained after removing the electric field cancellation signals in the second white driving signal W2.

In some embodiments, as shown in FIG. 11, in the case where N is equal to 7 (N=7), the sub-signals from a first phase to a seventh phase included in the chromatic driving signal are sequentially: an electric field cancellation signal C1, a chromatic pull-down signal C2, a seventh rectangular wave C3, an eighth rectangular wave C4, a first chromatic push-up signal C5, an another electric field cancellation signal C6 and a second chromatic push-up signal C7. The electric field cancellation signal C1 (or C6) is a signal that makes an electric field where the pixel is located zero. That is, a potential of the electric field cancellation signal C1 (or C6) is the same as the potential of the second electrode layer. The chromatic pull-down signal C2 is configured to drive the chromatic particles in the pixel to move to the side away from the display surface of the electronic ink screen, so as to balance running (movement) of the chromatic particles (e.g., the red particles). The seventh rectangular wave C3, a frequency of which is a seventh frequency, makes the chromatic particles wobble in advance. The eighth rectangular wave C4, a frequency of which is an eighth frequency, makes the chromatic particles continue to wobble. The first chromatic push-up signal C5 is configured to drive the chromatic particles in the pixel to move to the side proximate to the display surface of the electronic ink screen. The second chromatic push-up signal C7 is configured to drive the chromatic particles in the pixel to move to the side proximate to the display surface of the electronic ink screen, so that the pixel displays the chromatic color. The eighth frequency is greater than the seventh frequency. Since the chromatic particles (the red particles) are larger than the black particles in size, an effective duration of the chromatic pull-down signal C2 is longer than an effective duration of the black pull-down signal B21 and an effective duration of the white pull-down signal W21, and the chromatic particles need to be pushed up twice. A duration of the first chromatic push-up signal C5 is longer than a duration of the black push-up signal B26 and a duration of the white push-up signal W26, and a duration of the second chromatic push-up signal C7 is also longer than the duration of the black push-up signal B26 and the duration of the white push-up signal W26.

The first chromatic push-up signal C5 includes a first black pull-down sub-signal C51 and a first chromatic push-up sub-signal C52, and the second chromatic push-up signal C7 includes a second black pull-down sub-signal C71 and a second chromatic push-up sub-signal C72. The first black pull-down sub-signal C51 and the second black pull-down sub-signal C71 each are configured to pull down the black particles to a side farther away from the display surface of the electronic ink screen than the chromatic particles. The first chromatic push-up signal C52 and the second chromatic push-up signal C72 each are configured to push up the chromatic particles and the black particles simultaneously. Since a volume of the black particle is smaller than a volume of the chromatic particle, the black particle will run faster than the chromatic particle under action of the same signal. In order to prevent the black particles from running to a side closer to the display surface of the electronic ink screen than the chromatic particles, amplitudes of the first chromatic push-up sub-signal C52 and the second chromatic push-up sub-signal C72 are less than amplitudes of the black push-up signal B26 and the white push-up signal W26. For example, the first chromatic push-up signal C5 and the second chromatic push-up signal C7 may be the same.

For example, the charge polarity of the black particle is the same as charge polarity of the chromatic particle, and the volume of the black particle is smaller than the volume of the chromatic particle. When the first chromatic push-up sub-signal acts on the charged chromatic particles to make the chromatic particles move to the side proximate to the display surface of the electronic ink screen, the first chromatic push-up sub-signal also acts on the charged black particles to make the charged black particles also move to the side proximate to the display surface of the electronic ink screen. As a result, the black particles are mixed into the chromatic particles in some pixels of the electronic ink screen for displaying the chromatic color, thereby generating chromatic aberration. In order to solve this problem, the black particles and the chromatic particles are firstly layered by the first black pull-down sub-signal, so that the black particles are pulled down to the side farther away from the display surface of the electronic ink screen than the chromatic particles; then, when the first chromatic push-up sub-signal acts on the charged chromatic particles, even if it also acts on the black particles, the black particles are located on the side farther away from the display surface of the electronic ink screen than the chromatic particles, and thus the black particles are not mixed into the chromatic particles.

In some embodiments, the first frequency is equal to the fourth frequency, the second frequency is equal to the fifth frequency, and the third frequency is equal to the sixth frequency. In this way, a complexity of a driving process may be simplified.

In some other embodiments, the seventh frequency is equal to the second frequency, and the eighth frequency is equal to the third frequency. In this way, the complexity of the driving process may be simplified.

In some embodiments, the entire process of displaying the image to be displayed may be divided into N display driving phases, and in each display driving phase, only one sub-signal of a corresponding phase in each data driving signal is inputted to each pixel. S103 includes following steps.

In a j-th display driving phase of displaying the image to be displayed, the display control apparatus 2 sequentially scans the rows of pixels in the electronic ink screen 1. Steps of scanning the rows of pixels in the electronic ink screen 1 may be referred to the description in S102, which will not be described in detail here. Where j is greater than or equal to 1 and less than or equal to N ($1 \leq j \leq N$), that is, j is equal to 1, 2, 3, . . . , N (i=1, 2, 3, . . . , N).

Moreover, the display control apparatus 2 outputs a sub-signal of a j-th phase in the second black driving signal B2 to the pixel to be displayed in the black color in each row of pixels that is scanned, outputs a sub-signal of a j-th phase in the second white driving signal W2 to the pixel to be displayed in the white color in each row of pixels that is scanned, and outputs a sub-signal of a j-th phase in the chromatic driving signal C to the pixel to be displayed in the chromatic color in each row of pixels that is scanned. For example, the at least one processor 21 (e.g., the first processor 21*a*) in the display control apparatus 2 may control the source driver 24 to output corresponding sub-signals to each row of pixels that is scanned. For example, in a first display driving phase, a sub-signal W21 in the second white driving signal W2 is output to the pixel to be displayed in the white color, a sub-signal B21 in the second black driving signal B2 is output to the pixel to be displayed in the black color, and a sub-signal C1 in the chromatic driving signal C is output to the pixel to be displayed in the chromatic color.

It can be seen that, in the embodiments, in a process of refreshing the chromatic image (the image including three colors, i.e., the black color, the white color and the chromatic color) once, N display driving phases are required. In each display driving phase, each row of pixels needs to be scanned, and the sub-signals corresponding to the display driving phase are output to each row of pixels. In this way, in the case where the number of sub-signals included in the data driving signal changes, there is no need to change the scanning signal and the relevant clock signal.

In some other embodiments, it is also possible to scan the rows of pixels row by row, and when a row of pixels is scanned, a corresponding data driving signal (including N sub-signals) is output to each pixel in the row of pixels; then, a next row of pixels is scanned.

In some embodiments, the display control apparatus 2 may store a waveform file LUT WF_B2 of the second black driving signal B2, a waveform file LUT WF_W2 of the second white driving signal W2 and a waveform file LUT WF_C of the chromatic driving signal C. The waveform file is used to represent data of the data driving signal shown in FIG. 11. For example, referring to FIG. 6, the waveform files may be stored in the at least one memory 22 (e.g., the first memory 22*a*) of the display control apparatus 2. The at least one processor 21 (e.g., the first processor 21*a*) of the display control apparatus 2 may, according to the image to be displayed stored in the at least one memory 22 (e.g., the second memory 22*b*) and the waveform files stored in the at least one memory 22 (e.g., the first memory 22*a*), control the source driver 24 to output the second black driving signal corresponding to the waveform file LUT WF_B2 to the pixel to be displayed in the black color in the electronic ink screen, to output the second white driving signal corresponding to the waveform file LUT WF_W2 to the pixel to be displayed in the white color in the electronic ink screen and to output the chromatic driving signal corresponding to the waveform file LUT WF_C to the pixel corresponding to the chromatic pixel data in the electronic ink screen.

In order to ensure that the electronic ink screen can work normally at different temperatures, in some embodiments, referring to Table 2, at least two (e.g., Y, where Y is greater than or equal to 2 ($Y \geq 2$); and Table 2 is illustrated by taking an example in which Y is equal to X and equal to 3 (Y=X=3)) second temperature ranges that are preset respectively correspond to at least two second driving signal groups, and a second driving signal group includes a second black driving signal, a second white driving signal and a chromatic driving signal.

For example, the at least two second temperature ranges that are preset respectively correspond to at least two second waveform file groups that are stored, and a second waveform file group includes a waveform file LUT WF_B2 of the second black driving signal, a waveform file LUT WF_W2 of the second white driving signal and a waveform file LUT WF_C of the chromatic driving signal.

TABLE 2

| Serial number | Second temperature range (° C.) | Second waveform file group | Second driving signal group |
|---|---|---|---|
| 1 | ≤u1 | Second waveform file group 1 | Second driving signal group 1 |
| 2 | (u1, u2] | Second waveform | Second driving |

TABLE 2-continued

| Serial number | Second temperature range (° C.) | Second waveform file group | Second driving signal group |
|---|---|---|---|
| 3 | >u2 | file group 2<br>Second waveform file group 3 | signal group 2<br>Second driving signal group 3 |

For example, a j-th (1≤j≤Y) second temperature range corresponds to a second waveform file group j and a second driving signal group j in the memory 22 (e.g., the first memory 22*a*). The second waveform file group j includes a waveform file LUT WF_B2, a waveform file LUT WF_W2 and a waveform file LUT WF_C. For two second waveform file groups, at least one waveform file of the waveform file LUT WF_B2, the waveform file LUT WF_W2 and the waveform file LUT WF_C is different. For example, the waveform file LUT WF_B2 in the second waveform file group 1 is the same as the waveform file LUT WF_B2 in the second waveform file group 2, the waveform file LUT WF_W2 in the second waveform file group 1 is different from the waveform file LUT WF_W2 in the second waveform file group 2, and the waveform file LUT WF_C in the second waveform file group 1 is the same as the waveform file LUT WF_C in the second waveform file group 2. As another example, the waveform file LUT WF_B2 in the second waveform file group 1 is different from the waveform file LUT WF_B2 in the second waveform file group 3, the waveform file LUT WF_W2 in the second waveform file group 1 is also different from the waveform file LUT WF_W2 in the second waveform file group 3, and the waveform file LUT WF_C in the second waveform file group 1 is also different from the waveform file LUT WF_C in the second waveform file group 3.

The display control apparatus 2 may, according to a second temperature range which the ambient temperature is in, output the second black driving signal in a corresponding second driving signal group to the pixel to be displayed in the black color in the electronic ink screen 1, output the second white driving signal in the corresponding second driving signal group to the pixel to be displayed in the white color in the electronic ink screen 1, and output the chromatic driving signal in the corresponding second driving signal group to the pixel to be displayed in the chromatic color in the electronic ink screen 1.

For example, the display control apparatus 2 may output the second black driving signal to the pixel to be displayed in the black color in the electronic ink screen according to the waveform file LUT WF_B2 of the second black driving signal in the second waveform file group corresponding to the second temperature range which the ambient temperature is in; output the second white driving signal to the pixel to be displayed in the white color in the electronic ink screen according to the waveform file LUT WF_W2 of the second white driving signal in the second waveform file group corresponding to the second temperature range which the ambient temperature is in; and output the chromatic driving signal to the pixel to be displayed in the chromatic color in the electronic ink screen according to the waveform file LUT WF_C of the chromatic driving signal in the second waveform file group corresponding to the second temperature range which the ambient temperature is in.

For example, the at least one processor 21 (e.g., the first processor 21*a*) in the display control apparatus 2 may obtain the ambient temperature through the temperature sensor 25. If the ambient temperature is in a j-th second temperature range, according to the stored image to be displayed and the waveform file LUT WF_B2, the waveform file LUT WF_W2 and the waveform file LUT WF_C in the second waveform file group j, the at least one processor 21 controls the source driver 24 to output the second black driving signal corresponding to the waveform file LUT WF_B2 in the second waveform file group j (i.e., the second black driving signal in the second driving signal group j) to the pixel to be displayed in the black color, to output the second white driving signal corresponding to the waveform file LUT WF_W2 in the second waveform file group j (i.e., the second white driving signal in the second driving signal group j) to the pixel to be displayed in the white color, and to output the chromatic driving signal corresponding to the waveform file LUT WF_C in the second waveform file group j (i.e., the chromatic driving signal in the second driving signal group j) to the pixel to be displayed in the chromatic color.

In addition, the at least two second temperature ranges may be the same as or different from the at least two first temperature ranges. In a case where the at least two second temperature ranges are different from the at least two first temperature ranges, according to the determined types of the colors included in the image to be displayed, the display control apparatus 2 needs to determine a temperature range corresponding to the ambient temperature from the at least two temperature ranges corresponding to the types of the colors included in the image to be displayed. If the image to be displayed is a black-and-white image, a first temperature range corresponding to the ambient temperature is determined from the at least two first temperature ranges; and if the image to be displayed is a chromatic image, a second temperature range corresponding to the ambient temperature is determined from the at least two second temperature ranges. In a case where the at least two second temperature ranges are the same as the at least two first temperature ranges, that is, the at least two temperature ranges (e.g., the at least two first temperature ranges or the at least two second temperature ranges) that are preset are shared in two situations (that is, no matter whether the image to be displayed is a black-and-white image or a chromatic image), one temperature range is determined from the at least two temperature ranges that are preset according to the ambient temperature, so as to be configured as a subsequent selection of the first waveform file group or the second waveform file group. In this way, the display control apparatus 2 does not need to combine the image to be displayed when determining the temperature range. As an example, the at least two second temperature ranges are the same as the at least two first temperature ranges, that is, u1 is equal to w1 and u2 is equal to w2 (u1=w1 and u2=w2).

A 2.6-inch electronic ink display apparatus is taken as an example, the electronic ink display apparatus can display three colors, i.e., the black color, the white color and the red color. According to a scheme in the embodiments, at normal temperature, if the time for refreshing a chromatic image (a black-and-white-and-red image) once is 22 seconds, the time for refreshing a black-and-white image once is shortened to 18 seconds, and a refresh current is 20 mA; the power consumption may be saved by 80 mAs per refresh, where (22 s-18 s)×20 mA=80 mAs. Assuming that there are 100 times for refreshing black-and-white images in the total number of times for refreshing images per day, if calculated by 365 days per year, the power consumption may be saved by 811 mAh in one year, where 80 mAs×100 times per day×365 days=2920000 mAs=811 mAh. Generally, a capacitance of a button cell with a diameter of 24 mm is approximately 600 mAh, so that one button cell may be saved per year and a frequency of battery replacement may be reduced.

As shown in FIGS. 5 and 6, some embodiments of the present disclosure further provide a display control apparatus 2. The display control apparatus 2 includes the source driver 24 and the at least one processor 21 (e.g., including the first processor 21*a* and the second processor 21*b*). The at least one processor 21 (e.g., the first processor 21*a*) is configured to: in a case where colors of an image to be displayed include only the black color and the white color, control the source driver 24 to output a first black driving signal to the pixel to be displayed in the black color in the electronic ink screen, and to output a first white driving signal to the pixel to be displayed in the white color in the electronic ink screen; in a case where the colors of the image to be displayed include the black color, the white color and the chromatic color, control the source driver 24 to output a second black driving signal to the pixel to be displayed in the black color in the electronic ink screen, to output a second white driving signal to the pixel to be displayed in the white color in the electronic ink screen, and to output a chromatic driving signal to the pixel to be displayed in the chromatic color in the electronic ink screen. A duration of the first black driving signal is equal to or approximately equal to a duration of the first white driving signal, and a duration of the second black driving signal, a duration of the second white driving signal and a duration of the chromatic driving signal are equal or approximately equal; the duration of the second white driving signal is greater than the duration of the first white driving signal. In some embodiments, at least two first temperature ranges that are preset respectively correspond to at least two first driving signal groups, and a first driving signal group includes a first black driving signal and a first white driving signal. In the case where the colors of the image to be displayed include only the black color and the white color, the at least one processor 21 (e.g., the first processor 21*a*) is configured to according to a first temperature range which an ambient temperature is in, control the source driver 24 to output the first black driving signal in a corresponding first driving signal group to the pixel to be displayed in the black color in the electronic ink screen, and to output the first white driving signal in the corresponding first driving signal group to the pixel to be displayed in the white color in the electronic ink screen.

In some embodiments, at least two second temperature ranges that are preset respectively correspond to at least two second driving signal groups, and a second driving signal group includes a second black driving signal, a second white driving signal and a chromatic driving signal. In the case where the colors of the image to be displayed include the black color, the white color and the chromatic color, the at least one processor 21 (e.g., the first processor 21*a*) is configured to, according to a second temperature range which the ambient temperature is in, control the source driver 24 to output the second black driving signal in a corresponding second driving signal group to the pixel to be displayed in the black color in the electronic ink screen, to output the second white driving signal in the corresponding second driving signal group to the pixel to be displayed in the white color in the electronic ink screen, and to output the chromatic driving signal in the corresponding second driving signal group to the pixel to be displayed in the chromatic color in the electronic ink screen.

In some embodiments, the display control apparatus 2 further includes the at least one memory 22 (e.g., including the first memory 22*a* and the second memory 22*b*). The at least one memory 22 (e.g., the first memory 22*a*) is configured to store at least two first waveform file groups, a first waveform file group includes a waveform file of a first black driving signal and a waveform file of a first white driving signal. The at least two first waveform file groups respectively correspond to the at least two first temperature ranges. In the case where the colors of the image to be displayed include only the black color and the white color, the at least one processor 21 (e.g., the first processor 21*a*) is configured to: according to the waveform file of the first black driving signal in the first waveform file group corresponding to the first temperature range which the ambient temperature is in, control the source driver 24 to output the first black driving signal to the pixel to be displayed in the black color in the electronic ink screen; and according to the waveform file of the first white driving signal in the first waveform file group corresponding to the first temperature range which the ambient temperature is in, control the source driver 24 to output the first white driving signal to the pixel to be displayed in the white color in the electronic ink screen.

In some embodiments, the at least one memory 22 (the first memory 22*a*) is configured to store at least two second waveform file groups, and a second waveform file group includes a waveform file of a second black driving signal, a waveform file of a second white driving signal and a waveform file of a chromatic driving signal. The at least two second waveform file groups respectively correspond to the at least two second temperature ranges. In the case where the colors of the image to be displayed include the black color, the white color and the chromatic color, the at least one processor 21 (e.g., the first processor 21*a*) is configured to: according to the waveform file of the second black driving signal in the second waveform file group corresponding to the second temperature range which the ambient temperature is in, control the source driver 24 to output the second black driving signal to the pixel to be displayed in the black color in the electronic ink screen; according to the waveform file of the second white driving signal in the second waveform file group corresponding to the second temperature range which the ambient temperature is in, control the source driver 24 to output the second white driving signal to the pixel to be displayed in the white color in the electronic ink screen; and according to the waveform file of the chromatic driving signal in the second waveform file group corresponding to the second temperature range which the ambient temperature is in, control the source driver 24 to output the chromatic driving signal to the pixel to be displayed in the chromatic color in the electronic ink screen.

In some embodiments, the at least one memory 22 (e.g., the second memory 22*b*) is configured to store the image to be displayed.

In some embodiments, the first black driving signal and the first white driving signal each include sub-signals of M phases; the second black driving signal, the second white driving signal and the chromatic driving signal each include sub-signals of N phases. N is greater than M. The second black driving signal includes sub-signals of M phases that are the same as the sub-signals of M phases included in the first black driving signal, and the second white driving signal includes sub-signals of M phases that are the same as the sub-signals of M phases included in the first white driving signal.

In some embodiments, the display control apparatus 2 further includes a gate driver 23. The at least one processor 21 (e.g., the first processor 21*a*) is further configured to: control the gate driver 23 to sequentially scan the rows of pixels in the electronic ink screen in an i-th display driving phase of displaying the image to be displayed; and control the source driver 24 to output a sub-signal of an i-th phase in the first black driving signal to the pixel to be displayed in the black color in each row of pixels that is scanned, and to output a sub-signal of an i-th phase in the first white driving signal to the pixel to be displayed in the white color in each row of pixels that is scanned. Where i is greater than or equal to 1 and less than or equal to M ($1 \leq i \leq M$).

In some embodiments, the at least one processor 21 (e.g., the first processor 21*a*) is further configured to: control the gate driver 23 to sequentially scan the rows of pixels in the electronic ink screen in a j-th display driving phase of displaying the image to be displayed; and control the source driver 24 to output a sub-signal of a j-th phase in the second black driving signal to the pixel to be displayed in the black color in each row of pixels that is scanned, to output a sub-signal of a j-th phase in the second white driving signal to the pixel to be displayed in the white color in each row of pixels that is scanned, and to output a sub-signal of a j-th phase in the chromatic driving signal to the pixel to be displayed in the chromatic color in each row of pixels that is scanned. Where j is greater than or equal to 1 and less than or equal to N ($1 \leq j \leq N$).

In some embodiments, the at least one processor 21 (e.g., the first processor 21*a* or the second processor 21*b*) is further configured to obtain the image to be displayed and determine whether the image to be displayed includes chromatic pixel data. If the image to be displayed includes the chromatic pixel data, the colors of the image to be displayed include the black color, the white color and the chromatic color; and if the image to be displayed does not include the chromatic pixel data, the colors of the image to be displayed include only the black color and the white color.

In some embodiments, the at least one processor 21 (e.g., the first processor 21*a* or the second processor 21*b*) is further configured to receive a display mode control instruction configured to indicate that the colors of the image to be displayed include only the black color and the white color, or include the black color, the white color and the chromatic color. For example, the second processor 21*b* is configured to receive the display mode control instruction sent by the communication opposite-end device, and send the display mode control instruction to the first processor 21*a*. The first processor 21*a* is configured to receive the display mode control instruction sent by the second processor 21*b*. All relevant contents of steps involved in the above method embodiments may be referred to the description of the above devices, which will not be described in detail here.

In some embodiments, the display control apparatus may be divided into functional modules according to the above method embodiments. For example, the display control apparatus may be divided into functional modules according to respective functions, or two or more functions may be integrated into a functional module. The integrated module may be implemented in a form of hardware or in a form of software functional module. It will be noted that, division of the modules in the embodiments of the present disclosure is schematic, and is only a logical functional division, and there may exist other division manners in actual implementation.

Figure 12:
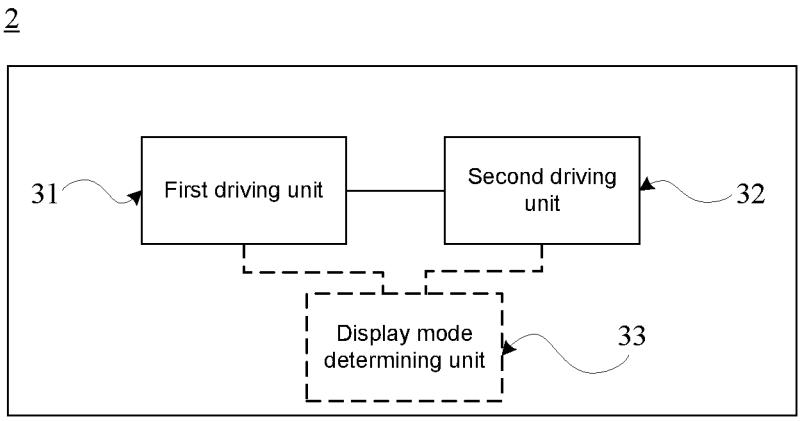
FIG. 12 is a structural diagram of yet another display control apparatus, in accordance with some embodiments of the present disclosure.

In a case where the functional modules are divided according to respective functions, as shown in FIG. 12, some embodiments of the present disclosure further provide a display control apparatus 2. The display control apparatus 2 includes a first driving unit 31 and a second driving unit 32.

The first driving unit 31 is configured to, in a case where colors of an image to be displayed include only the black color and the white color, output a first black driving signal to the pixel to be displayed in the black color in the electronic ink screen, and output a first white driving signal to the pixel to be displayed in the white color in the electronic ink screen.

The second driving unit 32 is configured to, in a case where the colors of the image to be displayed include the black color, the white color and the chromatic color, output a second black driving signal to the pixel to be displayed in the black color in the electronic ink screen, output a second white driving signal to the pixel to be displayed in the white color in the electronic ink screen, and output a chromatic driving signal to the pixel to be displayed in the chromatic color in the electronic ink screen.

A duration of the first black driving signal is equal to or approximately equal to a duration of the first white driving signal; a duration of the second black driving signal, a duration of the second white driving signal and a duration of the chromatic driving signal are equal or approximately equal; and the duration of the second white driving signal is greater than the duration of the first white driving signal.

In some embodiments, at least two first temperature ranges that are preset respectively correspond to at least two first driving signal groups, and a first driving signal group includes a first black driving signal and a first white driving signal. In the case where the colors of the image to be displayed include only the black color and the white color, the first driving unit 31 is configured to, according to a first temperature range which an ambient temperature is in, output the first black driving signal in a corresponding first driving signal group to the pixel to be displayed in the black color in the electronic ink screen, and output the first white driving signal in the corresponding first driving signal group to the pixel to be displayed in the white color in the electronic ink screen.

In some embodiments, at least two second temperature ranges that are preset respectively correspond to at least two second driving signal groups, and a second driving signal group includes a second black driving signal, a second white driving signal and a chromatic driving signal. In the case where the colors of the image to be displayed include the black color, the white color and the chromatic color, the second driving unit 32 is configured to, according to a second temperature range which the ambient temperature is in, output the second black driving signal in a corresponding second driving signal group to the pixel to be displayed in the black color in the electronic ink screen, output the second white driving signal in the corresponding second driving signal group to the pixel to be displayed in the white color in the electronic ink screen, and output the chromatic driving signal in the corresponding second driving signal group to the pixel to be displayed in the chromatic color in the electronic ink screen.

In some embodiments, the at least two first temperature ranges that are preset respectively correspond to at least two first waveform file groups that are stored, and a first waveform file group includes a waveform file of a first black driving signal and a waveform file of a first white driving signal. In the case where the colors of the image to be displayed include only the black color and the white color, the first driving unit 31 is configured to: according to the waveform file of the first black driving signal in the first waveform file group corresponding to the first temperature range which the ambient temperature is in, output the first black driving signal to the pixel to be displayed in the black color in the electronic ink screen; and according to the waveform file of the first white driving signal in the first waveform file group corresponding to the first temperature range which the ambient temperature is in, output the first white driving signal to the pixel to be displayed in the white color in the electronic ink screen.

In some embodiments, the at least two second temperature ranges that are preset respectively correspond to at least two second waveform file groups, and a second waveform file group includes a waveform file of a second black driving signal, a waveform file of a second white driving signal and a waveform file of a chromatic driving signal. In the case where the colors of the image to be displayed include the black color, the white color and the chromatic color, the second driving unit 32 is configured to: according to the waveform file of the second black driving signal in the second waveform file group corresponding to the second temperature range which the ambient temperature is in, output the second black driving signal to the pixel to be displayed in the black color in the electronic ink screen; according to the waveform file of the second white driving signal in the second waveform file group corresponding to the second temperature range which the ambient temperature is in, output the second white driving signal to the pixel to be displayed in the white color in the electronic ink screen; and according to the waveform file of the chromatic driving signal in the second waveform file group corresponding to the second temperature range which the ambient temperature is in, output the chromatic driving signal to the pixel to be displayed in the chromatic color in the electronic ink screen.

In some embodiments, as shown in FIG. 12, the display control apparatus 2 further includes a display mode determining unit 33. The display mode determining unit 33 is configured to obtain the image to be displayed and determine whether the image to be displayed includes chromatic pixel data. If the image to be displayed includes the chromatic pixel data, the colors of the image to be displayed include the black color, the white color and the chromatic color; and if the image to be displayed does not include the chromatic pixel data, the colors of the image to be displayed include only the black color and the white color. Alternatively, the display mode determining unit 33 is configured to receive a display mode control instruction configured to indicate that the colors of the image to be displayed include only the black color and the white color, or include the black color, the white color and the chromatic color.

All relevant contents of steps involved in the above method embodiments may be referred to the functional description of the above functional modules, which will not be described in detail here.

Some embodiments of the present disclosure provide a computer-readable storage medium (e.g., a non-transitory computer-readable storage medium) that has stored computer program instructions that, when run on the electronic ink display apparatus, causes the electronic ink display apparatus to perform the control method for the electronic ink screen in any of the above embodiments. Some embodiments of the present disclosure provide a computer-readable storage medium (e.g., a non-transitory computer-readable storage medium) that has stored computer program instructions that, when run on a processor, cause the processor to perform one or more steps of the control method for the electronic ink screen as described in any of the above embodiments.

For example, the computer-readable storage medium may include, but is not limited to, a magnetic storage device (e.g., a hard disk, a floppy disk or a magnetic tape), an optical disk (e.g., a compact disk (CD), a digital versatile disk (DVD)), a smart card, and a flash memory device (e.g., an erasable programmable read-only memory (EPROM), a card, a stick or a key driver). Various computer-readable storage media described in the embodiments of the present disclosure may represent one or more devices for storing information and/or other machine-readable storage media for storing information. The term "machine-readable storage medium" may include, but is not limited to, wireless channels and various other media capable of storing, containing and/or carrying instructions and/or data.

Some embodiments of the present disclosure further provide a computer program product. The computer program product includes computer program instructions that, when executed on a computer, cause the computer to perform one or more steps of the control method for the electronic ink screen as described in the above embodiments.

Some embodiments of the present disclosure further provide a computer program. When executed on a computer, the computer program causes the computer to perform one or more steps of the control method for the electronic ink screen as described in the above embodiments.

Beneficial effects of the computer-readable storage medium, the computer program product and the computer program are the same as the beneficial effects of the control method for the electronic ink screen as described in some of the above embodiments, which will not be described in detail here.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

What is claimed is:

1. A control method for an electronic ink screen, comprising:

when colors of an image to be displayed include only a black color and a white color, outputting a first black driving signal to a pixel to be displayed in the black color in the electronic ink screen, and outputting a first white driving signal to a pixel to be displayed in the white color in the electronic ink screen; and when the colors of the image to be displayed include the black color, the white color and a chromatic color, outputting a second black driving signal to the pixel to be displayed in the black color in the electronic ink screen, outputting a second white driving signal to the pixel to be displayed in the white color in the electronic ink screen, and outputting a chromatic driving signal to a pixel to be displayed in the chromatic color in the electronic ink screen, wherein a duration of the first black driving signal is equal to duration of the first white driving signal; a duration of the second black driving signal, a duration of the second white driving signal and a duration of the chromatic driving signal are equal; and the duration of the second white driving signal is greater than the duration of the first white driving signal.

2. The control method for the electronic ink screen according to claim 1, wherein at least two first temperature ranges that are preset respectively correspond to at least two first driving signal groups, and a first driving signal group includes a first black driving signal and a first white driving signal; and in the case where the colors of the image to be displayed include only the black color and the white color, outputting the first black driving signal to the pixel to be displayed in the black color in the electronic ink screen and outputting the first white driving signal to the pixel to be displayed in the white color in the electronic ink screen, includes: according to a first temperature range which an ambient temperature is in, outputting the first black driving signal in a corresponding first driving signal group to the pixel to be displayed in the black color in the electronic ink screen, and outputting the first white driving signal in the corresponding first driving signal group to the pixel to be displayed in the white color in the electronic ink screen;

and/or at least two second temperature ranges that are preset respectively correspond to at least two second driving signal groups, and a second driving signal group includes a second black driving signal, a second white driving signal and a chromatic driving signal; and in the case where the colors of the image to be displayed include the black color, the white color and the chromatic color, outputting the second black driving signal to the pixel to be displayed in the black color in the electronic ink screen, outputting the second white driving signal to the pixel to be displayed in the white color in the electronic ink screen and outputting the chromatic driving signal to the pixel to be displayed in the chromatic color in the electronic ink screen, includes: according to a second temperature range which the ambient temperature is in, outputting the second black driving signal in a corresponding second driving signal group to the pixel to be displayed in the black color in the electronic ink screen, outputting the second white driving signal in the corresponding second driving signal group to the pixel to be displayed in the white color in the electronic ink screen and outputting the chromatic driving signal in the corresponding second driving signal group to the pixel to be displayed in the chromatic color in the electronic ink screen.

3. The control method for the electronic ink screen according to claim 2, wherein the at least two first temperature ranges that are preset respectively correspond to at least two first waveform file groups that are stored, and a first waveform file group includes a waveform file of the first black driving signal and a waveform file of the first white driving signal; and in the case where the colors of the image to be displayed include only the black color and the white color, outputting the first black driving signal to the pixel to be displayed in the black color in the electronic ink screen and outputting the first white driving signal to the pixel to be displayed in the white color in the electronic ink screen, includes: according to the waveform file of the first black driving signal in the first waveform file group corresponding to the first temperature range which the ambient temperature is in, outputting the first black driving signal to the pixel to be displayed in the black color in the electronic ink screen; and according to the waveform file of the first white driving signal in the first waveform file group corresponding to the first temperature range which the ambient temperature is in, outputting the first white driving signal to the pixel to be displayed in the white color in the electronic ink screen;

and/or the at least two second temperature ranges that are preset respectively correspond to at least two second waveform file groups, and a second waveform file group includes a waveform file of the second black driving signal, a waveform file of the second white driving signal and a waveform file of the chromatic driving signal; and in the case where the colors of the image to be displayed include the black color, the white color and the chromatic color, outputting the second black driving signal to the pixel to be displayed in the black color in the electronic ink screen, outputting the second white driving signal to the pixel to be displayed in the white color in the electronic ink screen and outputting the chromatic driving signal to the pixel to be displayed in the chromatic color in the electronic ink screen, includes: according to the waveform file of the second black driving signal in a second waveform file group corresponding to the second temperature range which the ambient temperature is in, outputting the second black driving signal to the pixel to be displayed in the black color in the electronic ink screen; according to the waveform file of the second white driving signal in the second waveform file group corresponding to the second temperature range which the ambient temperature is in, outputting the second white driving signal to the pixel to be displayed in the white color in the electronic ink screen; and according to the waveform file of the chromatic driving signal in the second waveform file group corresponding to the second temperature range which the ambient temperature is in, outputting the chromatic driving signal to the pixel to be displayed in the chromatic color in the electronic ink screen.

4. The control method for the electronic ink screen according to claim 1, wherein the first black driving signal and the first white driving signal each include sub-signals of M phases; the second black driving signal, the second white driving signal and the chromatic driving signal each include sub-signals of N phases; N is greater than M; and the second black driving signal includes sub-signals of M phases that are the same as the sub-signals of M phases included in the first black driving signal, and the second white driving signal includes sub-signals of M phases that are the same as the sub-signals of M phases included in the first white driving signal.

5. The control method for the electronic ink screen according to claim 4, wherein outputting the first black driving signal to the pixel to be displayed in the black color in the electronic ink screen and outputting the first white driving signal to the pixel to be displayed in the white color in the electronic ink screen, includes:

scanning rows of pixels in the electronic ink screen sequentially in an i-th display driving phase of displaying the image to be displayed; outputting a sub-signal of an i-th phase in the first black driving signal to the pixel to be displayed in the black color in each row of pixels that is scanned, and outputting a sub-signal of an i-th phase in the first white driving signal to the pixel to be displayed in the white color in each row of pixels that is scanned; wherein i is greater than or equal to 1 and less than or equal to M ($1 \le i \le M$);

and/or outputting the second black driving signal to the pixel to be displayed in the black color in the electronic ink screen, outputting the second white driving signal to the pixel to be displayed in the white color in the electronic ink screen and outputting the chromatic driving signal to the pixel to be displayed in the chromatic color in the electronic ink screen, includes:

scanning the row of pixels in the electronic ink screen sequentially in a j-th display driving phase of displaying the image to be displayed; outputting a sub-signal of a j-th phase in the second black driving signal to the pixel to be displayed in the black color in each row of pixels that is scanned, outputting a sub-signal of a j-th phase in the second white driving signal to the pixel to be displayed in the white color in each row of pixels that is scanned, and outputting a sub-signal of a j-th phase in the chromatic driving signal to the pixel to be displayed in the chromatic color in each row of pixels that is scanned; wherein j is greater than or equal to 1 and less than or equal to N ($1 \leq j \leq N$).

6. The control method for the electronic ink screen according to claim 4, wherein N is equal to 7 (N=7), and M is equal to 5 (M=5).

7. The control method for the electronic ink screen according to claim 6, wherein the sub-signals from a first phase to a seventh phase included in the second black driving signal are sequentially:

a black pull-down signal configured to drive black particles in a pixel to move to a side away from a display surface of the electronic ink screen;

a first rectangular wave, a frequency of the first rectangular wave being a first frequency;

a second rectangular wave, a frequency of the second rectangular wave being a second frequency;

a third rectangular wave, a frequency of the third rectangular wave being a third frequency;

an electric field cancellation signal;

a black push-up signal configured to drive the black particles in the pixel to move to a side proximate to the display surface of the electronic ink screen; and an another electric field cancellation signal;

the sub-signals from a first phase to a fifth phase included in the first black driving signal are sequentially: the black pull-down signal, the first rectangular wave, the second rectangular wave, the third rectangular wave and the black push-up signal that are all in the second black driving signal; and the first frequency is greater than the third frequency, and the third frequency is greater than the second frequency.

8. The control method for the electronic ink screen according to claim 6, wherein the sub-signals from a first phase to a seventh phase included in the second white driving signal are sequentially:

a white pull-down signal configured to drive white particles in a pixel to move to a side away from a display surface of the electronic ink screen;

a fourth rectangular wave, a frequency of the fourth rectangular wave being a fourth frequency;

a fifth rectangular wave, a frequency of the fifth rectangular wave being a fifth frequency;

a sixth rectangular wave, a frequency of the sixth rectangular wave being a sixth frequency;

an electric field cancellation signal;

a white push-up signal configured to drive the white particles in the pixel to move to a side proximate to the display surface of the electronic ink screen; and an another electric field cancellation signal;

the sub-signals from a first phase to a fifth phase included in the first white driving signal are sequentially: the white pull-down signal, the fourth rectangular wave, the fifth rectangular wave, the sixth rectangular wave and the white push-up signal that are all in the second white driving signal; and the fourth frequency is greater than the sixth frequency, and the sixth frequency is greater than the fifth frequency.

9. The control method for the electronic ink screen according to claim 6, wherein the sub-signals from a first phase to a seventh phase included in the chromatic driving signal are sequentially:

an electric field cancellation signal;

a chromatic pull-down signal configured to drive chromatic particles in a pixel to move to a side away from a display surface of the electronic ink screen;

a seventh rectangular wave, a frequency of the seventh rectangular wave being a seventh frequency;

an eighth rectangular wave, a frequency of the eighth rectangular wave being an eighth frequency;

a first chromatic push-up signal configured to drive the chromatic particles in the pixel to move to a side proximate to the display surface of the electronic ink screen;

an another electric field cancellation signal; and a second chromatic push-up signal configured to drive the chromatic particles in the pixel to move to the side proximate to the display surface of the electronic ink screen; and the eighth frequency is greater than the seventh frequency.

10. The control method for the electronic ink screen according to claim 8, wherein the sub-signals from a first phase to a seventh phase included in the second black driving signal are sequentially:

a black pull-down signal configured to drive black particles in a pixel to move to a side away from a display surface of the electronic ink screen;

a first rectangular wave, a frequency of the first rectangular wave being a first frequency;

a second rectangular wave, a frequency of the second rectangular wave being a second frequency;

a third rectangular wave, a frequency of the third rectangular wave being a third frequency;

an electric field cancellation signal;

a black push-up signal configured to drive the black particles in the pixel to move to a side proximate to the display surface of the electronic ink screen; and an another electric field cancellation signal;

the first frequency is equal to the fourth frequency, the second frequency is equal to the fifth frequency, and the third frequency is equal to the sixth frequency.

11. The control method for the electronic ink screen according to claim 9, wherein the sub-signals from a first phase to a seventh phase included in the second black driving signal are sequentially:

a black pull-down signal configured to drive black particles in a pixel to move to a side away from a display surface of the electronic ink screen;

a first rectangular wave, a frequency of the first rectangular wave being a first frequency;

a second rectangular wave, a frequency of the second rectangular wave being a second frequency;

a third rectangular wave, a frequency of the third rectangular wave being a third frequency;

an electric field cancellation signal;

a black push-up signal configured to drive the black particles in the pixel to move to a side proximate to the display surface of the electronic ink screen; and an another electric field cancellation signal;

the seventh frequency is equal to the second frequency, and the eighth frequency is equal to the third frequency.

12. The control method for the electronic ink screen according to claim 1, further comprises:

obtaining the image to be displayed; determining whether the image to be displayed includes chromatic pixel data; if the image to be displayed includes the chromatic pixel data, the colors of the image to be displayed including the black color, the white color and the chromatic color; and if the image to be displayed does not include the chromatic pixel data, the colors of the image to be displayed including only the black color and the white color; or receiving a display mode control instruction configured to indicate that the colors of the image to be displayed include only the black color and the white color, or include the black color, the white color and the chromatic color.

13. A display control apparatus, comprising:

a source driver;

at least one processor configured to: when colors of an image to be displayed include only a black color and a white color, control the source driver to output a first black driving signal to a pixel to be displayed in the black color in an electronic ink screen, and to output a first white driving signal to a pixel to be displayed in the white color in the electronic ink screen; and when the colors of the image to be displayed include the black color, the white color and a chromatic color, control the source driver to output a second black driving signal to the pixel to be displayed in the black color in the electronic ink screen, to output a second white driving signal to the pixel to be displayed in the white color in the electronic ink screen, and to output a chromatic driving signal to a pixel to be displayed in the chromatic color in the electronic ink screen, wherein a duration of the first black driving signal is equal to a duration of the first white driving signal; a duration of the second black driving signal, a duration of the second white driving signal and a duration of the chromatic driving signal are equal; and the duration of the second white driving signal is greater than the duration of the first white driving signal.

14. The display control apparatus according to claim 13, wherein at least two first temperature ranges that are preset respectively correspond to at least two first driving signal groups, and a first driving signal group includes a first black driving signal and a first white driving signal; the at least one processor is configured to, in the case where the colors of the image to be displayed include only the black color and the white color, according to a first temperature range which an ambient temperature is in, control the source driver to output the first black driving signal in a corresponding first driving signal group to the pixel to be displayed in the black color in the electronic ink screen, and to output the first white driving signal in the corresponding first driving signal group to the pixel to be displayed in the white color in the electronic ink screen;

and/or at least two second temperature ranges that are preset respectively correspond to at least two second driving signal groups, and a second driving signal group includes a second black driving signal, a second white driving signal and a chromatic driving signal; the at least one processor is configured to, in the case where the colors of the image to be displayed include the black color, the white color and the chromatic color, according to a second temperature range which the ambient temperature is in, control the source driver to output the second black driving signal in a corresponding second driving signal group to the pixel to be displayed in the black color in the electronic ink screen, to output the second white driving signal in the corresponding second driving signal group to the pixel to be displayed in the white color in the electronic ink screen, and to output the chromatic driving signal in the corresponding second driving signal group to the pixel to be displayed in the chromatic color in the electronic ink screen.

15. The display control apparatus according to claim 14, further comprising at least one memory, wherein the at least one memory is configured to store at least two first waveform file groups, and a first waveform file group includes a waveform file of the first black driving signal and a waveform file of the first white driving signal; the at least two first waveform file groups respectively correspond to the at least two first temperature ranges;

in the case where the colors of the image to be displayed include only the black color and the white color, the at least one processor is configured to: according to the waveform file of the first black driving signal in the first waveform file group corresponding to the first temperature range which the ambient temperature is in, control the source driver to output the first black driving signal to the pixel to be displayed in the black color in the electronic ink screen; and according to the waveform file of the first white driving signal in the first waveform file group corresponding to the first temperature range which the ambient temperature is in, control the source driver to output the first white driving signal to the pixel to be displayed in the white color in the electronic ink screen;

and/or the at least one memory is configured to store at least two second waveform file groups, and a second waveform file group includes a waveform file of the second black driving signal, a waveform file of the second white driving signal and a waveform file of the chromatic driving signal; the at least two second waveform file groups respectively correspond to the at least two second temperature ranges;

in the case where the colors of the image to be displayed include the black color, the white color and the chromatic color, the at least one processor is configured to: according to the waveform file of the second black driving signal in the second waveform file group corresponding to the second temperature range which the ambient temperature is in, control the source driver to output the second black driving signal to the pixel to be displayed in the black color in the electronic ink screen; according to the waveform file of the second white driving signal in the second waveform file group corresponding to the second temperature range which the ambient temperature is in, control the source driver to output the second white driving signal to the pixel to be displayed in the white in the electronic ink screen; and according to the waveform file of the chromatic driving signal in the second waveform file group corresponding to the second temperature range which the ambient temperature is in, control the source driver to output the chromatic driving signal to the pixel to be displayed in the chromatic color in the electronic ink screen.

16. The display control apparatus according to claim 13, wherein the first black driving signal and the first white driving signal each include sub-signals of M phases; the second black driving signal, the second white driving signal and the chromatic driving signal each include sub-signals of N phases; N is greater than M; and the second black driving signal includes sub-signals of M phases that are the same as the sub-signals of M phases included in the first black driving signal, and the second white driving signal includes sub-signals of M phases that are the same as the sub-signals of M phases included in the first white driving signal.

17. The display control apparatus according to claim 16, further comprising a gate driver;

the at least one processor being further configured to: control the gate driver to sequentially scan rows of pixels in the electronic ink screen in an i-th display driving phase of displaying the image to be displayed; control the source driver to output a sub-signal of an i-th phase in the first black driving signal to the pixel to be displayed in the black color in each row of pixels that is scanned, and to output a sub-signal of an i-th phase in the first white driving signal to the pixel to be displayed in the white color in each row of pixels that is scanned; wherein i is greater than or equal to 1 and less than or equal to M ($1 \leq i \leq M$);

and/or the at least one processor being further configured to: control the gate driver to sequentially scan the rows of pixels in the electronic ink screen in a j-th display driving phase of displaying the image to be displayed; control the source driver to output a sub-signal of a j-th phase in the second black driving signal to the pixel to be displayed in the black color in each row of pixels that is scanned, to output a sub-signal of a j-th phase in the second white driving signal to the pixel to be displayed in the white color in each row of pixels that is scanned, and to output a sub-signal of a j-th phase in the chromatic driving signal to the pixel to be displayed in the chromatic color in each row of pixels that is scanned; wherein j is greater than or equal to 1 and less than or equal to N ($1 \leq j \leq N$).

18. The display control apparatus according to claim 13, wherein the at least one processor is further configured to obtain the image to be displayed and determine whether the image to be displayed includes chromatic pixel data; if the image to be displayed includes the chromatic pixel data, the colors of the image to be displayed include the black color, the white color and the chromatic color; and if the image to be displayed does not include the chromatic pixel data, the colors of the image to be displayed include only the black color and the white color; or the at least one processor is further configured to receive a display mode control instruction configured to indicate that the colors of the image to be displayed include only the black color and the white color, or include the black color, the white color and the chromatic color.

19. An electronic ink display apparatus, comprising:

an electronic ink display screen; and the display control apparatus according to claim 13.

20. A non-transitory computer-readable storage medium having stored computer program instructions that, when run on an electronic ink display apparatus, cause the electronic ink display apparatus to perform the control method for the electronic ink screen according to claim 1.

* * * * *